US012503843B2

(12) United States Patent
Yin et al.

(10) Patent No.: US 12,503,843 B2
(45) Date of Patent: Dec. 23, 2025

(54) ARCHITECTURAL FIDUCIAL STRUCTURE AND CONSTRUCTION METHOD USING THE SAME

(71) Applicant: RUENTEX ENGINEERING & CONSTRUCTION CO., LTD., Taipei (TW)

(72) Inventors: Samuel Yin, Taipei (TW); Jui-Chen Wang, Taipei (TW); Jhih-Syuan Chen, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 238 days.

(21) Appl. No.: 18/241,666

(22) Filed: Sep. 1, 2023

(65) Prior Publication Data

US 2024/0084575 A1 Mar. 14, 2024

(30) Foreign Application Priority Data

Sep. 8, 2022 (TW) ..... 111134171

(51) Int. Cl.
*E04B 1/04* (2006.01)
*E04B 1/41* (2006.01)
*E04B 2/56* (2006.01)

(52) U.S. Cl.
CPC ..... *E04B 1/04* (2013.01); *E04B 1/41* (2013.01); *E04B 2/56* (2013.01)

(58) Field of Classification Search
CPC ... E04C 2/06; E04B 5/023; E04B 2/56; E04B 1/04; E04B 1/41
USPC .... 52/583.1, 283, 281, 293.3, 250, 251, 260
See application file for complete search history.

(56) References Cited

U.S. PATENT DOCUMENTS 3,473,273 A * 10/1969 Gunkel ..... E04B 1/348 52/432
4,909,001 A * 3/1990 Gonzalez Espinosa de Los Monteros ..... E04B 1/04 52/251
5,678,372 A * 10/1997 Thomson ..... E04B 1/0007 52/287.1
5,761,862 A * 6/1998 Hendershot ..... E04B 1/4121 52/270
7,900,411 B2 * 3/2011 Antonic ..... E04H 9/14 52/293.3
8,336,276 B2 * 12/2012 Tikhovskiy ..... E04B 5/28 52/236.8
2008/0098676 A1 * 5/2008 Hutchens ..... B28B 23/00 52/282.3

(Continued)

*Primary Examiner* — Paola Agudelo
(74) *Attorney, Agent, or Firm* — Juan Carlos A. Marquez; Marquez IP Law Office, PLLC

(57) ABSTRACT

An architectural fiducial structure and a construction method using the same are provided. The construction method includes: providing a first fiducial structure, wherein the fiducial structure has a first portion extending along a first direction, a second portion extending along a second direction and a precasting column structure, and wherein the first direction and the second direction forms an angle; providing a first shear wall extending along the first direction and connecting a first end of the first shear wall to the first portion of the first fiducial structure; and providing a second shear wall extending along the second direction and connecting a first end of the second shear wall to the second portion of the first fiducial structure.

17 Claims, 24 Drawing Sheets

(56) References Cited

U.S. PATENT DOCUMENTS

| | | | | |
|---|---|---|---|---|
| 2015/0040505 | A1* | 2/2015 | Chu | B28B 7/0082 264/219 |
| 2017/0002558 | A1* | 1/2017 | Hou | E04C 2/288 |
| 2019/0218771 | A1* | 7/2019 | Wawi | E04B 2/12 |
| 2021/0062494 | A1* | 3/2021 | Mou | E04C 3/292 |
| 2021/0156142 | A1* | 5/2021 | Ustinov | E04B 1/34326 |

* cited by examiner

ARCHITECTURAL FIDUCIAL STRUCTURE AND CONSTRUCTION METHOD USING THE SAME

BACKGROUND

1. Field of the Disclosure

The subject disclosure relates to an architectural fiducial structure and a construction method using the same, particularly used for constructing two shear walls extending in different directions.

2. Description of Related Art

Conventionally, constructing two interconnected shear walls extending in different directions, such as constructing two interconnected shear walls forming approximately a 90-degree angle involves the process of laying out the structure on-site (e.g., locating site boundaries and levels) and then assembling the steel bars and pouring concrete in spaces formed by form boards at the construction site. However, such conventional construction method is cumbersome and imprecise.

SUMMARY

According to one embodiment of the instant disclosure, a construction method includes: providing a first fiducial structure, wherein the first fiducial structure has a precast column structure, a first portion extending along a first direction from the precast column structure, a second portion extending along a second direction from the precast column structure wherein the first direction and the second direction are angled relative to each other; providing a first shear wall extending along the first direction; connecting a first end of the first shear wall to the first portion of the first fiducial structure; providing a second shear wall extending along the second direction; and connecting a first end of the second shear wall to the second portion of the first fiducial structure.

According to another example embodiment of the instant disclosure, a fiducial structure includes a precast column structure, a first portion connected to a first side of the precast column and a second portion connected to a second side of the precast column. The second side is adjacent to the first side. The first portion is configured to connect one of the two shear walls, and the second portion is configured to connect the other one of the two shear walls.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

Aspects of some embodiments of the present disclosure are readily understood from the following detailed description when read with the accompanying figures. It should be noted that various structures may not be drawn to scale, and dimensions of the various structures may be arbitrarily increased or reduced for clarity of discussion.

DETAILED DESCRIPTION

Figure 1A:
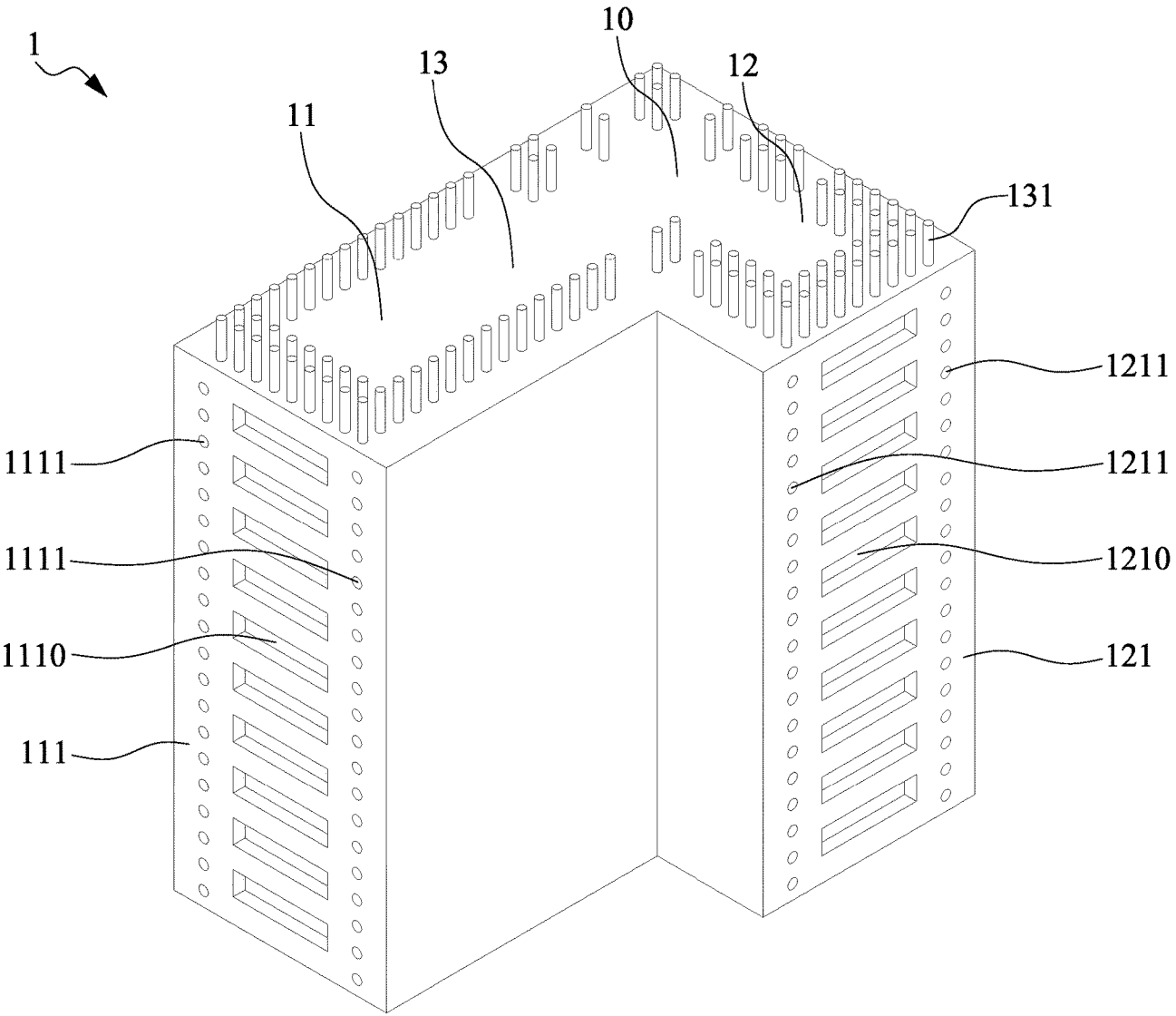
FIG. 1A is a schematic perspective view of a fiducial structure for constructing shear walls in accordance with one embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

It should be understood that, although the terms first, second, etc. may be used herein to describe various elements, these elements should not be limited by these terms. Unless indicated otherwise, these terms are only used to distinguish one element from another element.

As used herein, the terms "approximately," "substantially," "substantial" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to 100% For example, two numerical values can be deemed to be "substantially" the same or equal if a difference between the values is less than or equal to ±10% of an average of the values, such as less than or equal to 15%, less than or equal to ±4%, less than or equal to ±3%, less than or equal to ±2%, less than or equal to ±1%, less than or equal to ±0.5%, less than or equal to ±0.1%, or less than or equal to ±0.05%.

Figure 1B:
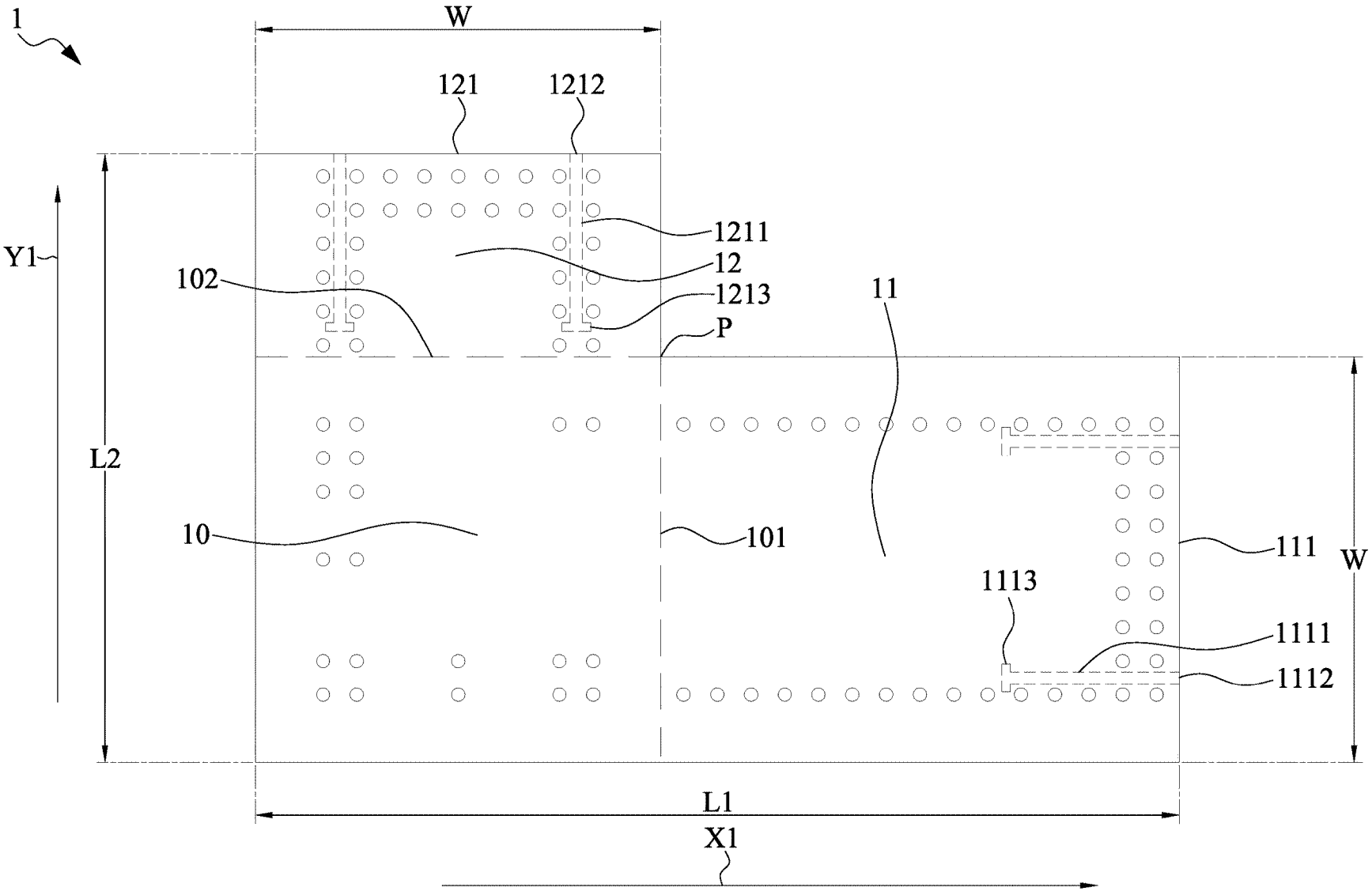
FIG. 1B is a schematic top plan view of a fiducial structure for constructing shear walls in accordance with one embodiment of the present disclosure.

FIG. 1A is a schematic perspective view of a fiducial structure 1 in accordance with one embodiment of the present disclosure. FIG. 1B is a schematic top plan view of the fiducial structure 1 for constructing shear walls in accordance with one embodiment of the present disclosure. Referring to FIG. 1A and FIG. 1B, the fiducial structure 1 includes a middle portion 10, a first guide portion 11 and a second guide portion 12, which are precast together. For example, the middle portion 10, the first guide portion 11 and the second guide portion 12 are collectively manufactured to form an integral unit in a factory and then transported to the construction site. In some embodiments of the present disclosure, the middle portion 10 is a precast column structure and the first guide portion 11 and/or the second guide portion 12 are made on site.

As shown in FIG. 1B, the first guide portion 11 is defined by a (virtual) side surface 101 between the first guide portion 11 and the middle portion 10, while the second guide portion 12 is defined by another (virtual) side surface 102 between the second guide portion 12 and the middle portion 10. In some embodiments of the present disclosure, the side surface 101 of the middle portion 10 is connected to and is angled with respect to the side surface 102 at a point P. For example, the side surface 101 joints the side surface 102 at a point P and are angled with respect to each other at approximate 90-degree. The first guide portion 11 extends from the side surface 101 of the middle portion 10 in the X1 direction and have a free end 111 located away from the middle portion 10. The second guide portion 12 extends from the side surface 102 of the middle portion 10 in the Y1 direction and have a free end 121 located away from the middle portion 10. In some embodiments of the present disclosure, the X1 direction and the Y1 direction are approximately perpendicular to each other. That is, the first guide portion 11 and the second guide portion 12 are approximately perpendicular to each other. In some embodiments of the present disclosure, a distance between the free end 111 of the first guide portion 11 and the side surface 101 of the middle portion 10 is different from a distance between the free end 121 of the second guide portion 12 and the side surface 102 of the middle portion. That is, a length of the first guide portion 11 may be different from that of the second guide portion 12. In some embodiments of the present disclosure, the length of the first guide portion 11 may be greater than the length of the second guide portion 12. As shown in FIG. 1B, the length of the fiducial structure 1 along the X1 direction, L1, may be approximately 2.6 meters, while the length along the Y1 direction, L2, may be approximately 1.6 meters. The width of the first guide portion 11 or the second guide portion 12, W, may be approximately 1 meter.

Referring to FIG. 1A and FIG. 1B again, the free end 111 of the first guide portion 11 have multiple recesses 1110 on its surface. These recesses 1110 are arranged approximately along the height of the fiducial structure 1. The recesses 1110 are configured to provide more contact area between the shear wall and the first guide portion 11 of the fiducial structure 1, so that the connection between them is enhanced. In addition, a multiple of rebar couplers 1111 are embedded within the first guide portion 11 and positioned adjacent to the recesses 1110 of the first guide portion 11. In some embodiments, the rebar couplers 1111 are generally arranged along the height of the fiducial structure 1 and disposed at both lateral sides of the free end 111 of the fiducial structure 1. As shown in FIG. 1B, in some embodiments of the present disclosure, the rebar couplers 1111 have one end portion 1112 configured to be exposed on the surface of the free end 111 of the first guide portion 11. In some embodiments, the end portion 1112 of the rebar couplers 1111 include internal threads (not shown) configured to connect with the reinforcing steels of the shear wall (not shown). The opposing end of the rebar couplers 1111 have a T-shaped structure 1113 for anchoring the rebar couplers 1111 in the first guide portion 11.

Further, as shown in FIG. 1A, the free end 121 of the second guide portion 12 has multiple recesses 1210 on its surface. These recesses 1210 are arranged approximately along the height of the fiducial structure 1. The recesses 1210 are configured to provide more contact area between the shear wall and the second guide portion 12 of the fiducial structure 1, so that the connection between them is enhanced. In addition, a multiple of rebar couplers 1211 may be embedded within the second guide portion 12 and positioned adjacent to the recesses 1210 of the second guide portion 12. In some embodiments of the present disclosure, the rebar couplers 1211 are generally arranged along the height of the fiducial structure 1 and disposed at both lateral sides of the free end 121 of the fiducial structure 1. As shown in FIG. 1B, in some embodiments of the present disclosure, the rebar couplers 1211 have one end portion 1212 configured to be exposed on the surface of the free end 121 of the second guide portion 12. The end portion 1212 of the rebar couplers 1211 includes the internal threads (not shown) configured to connect with the reinforcing steel of the shear wall (not shown). The opposing end of the rebar couplers 1211 has a T-shaped structure 1213 for anchoring the rebar couplers 1211 in the second guide portion 12.

Figure 1C:
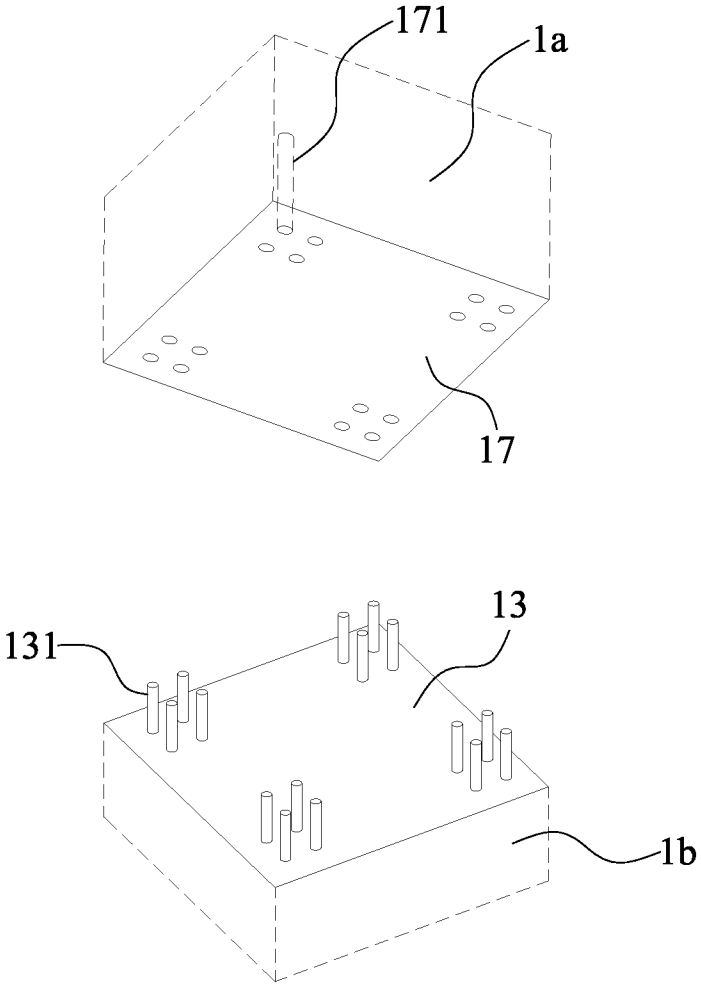
FIG. 1C is a schematic view showing mutually stacked sub-fiducial structures in accordance with another embodiment of the present disclosure.

Further, referring to FIG. 1B and FIG. 1C, FIG. 1C illustrates a schematic diagram showing the vertical stacking and combination of the parts 1*a*, 1*b* of the middle portion 10 of the fiducial structure 1. In some embodiments, the parts of the first guide portion 11 and the second guide portion 12 of the fiducial structure 1 may also be stacked in a similar manner. With this stacking arrangement, the overall height of the fiducial structure 1 can be adjusted according to the required design. As shown in FIG. 1C, the upper surface 13 of the lower fiducial structure 1*b* has multiple steel bars 131 protruded therefrom, while the bottom of the upper fiducial structure 1*a* may be embedded with multiple rebar couplers 171 exposed to the bottom surface 17 of the upper fiducial structure 1*a*. In operation, the upper fiducial structure 1*a* is stacked vertically on the upper surface 13 of the lower fiducial structure 1*b* wherein the steel bars 131 on the upper surface 13 of the lower fiducial structure 1*b* are aligned and connected with the rebar couplers 171 embedded at the bottom of the upper fiducial structure 1*a*.

Figure 2:
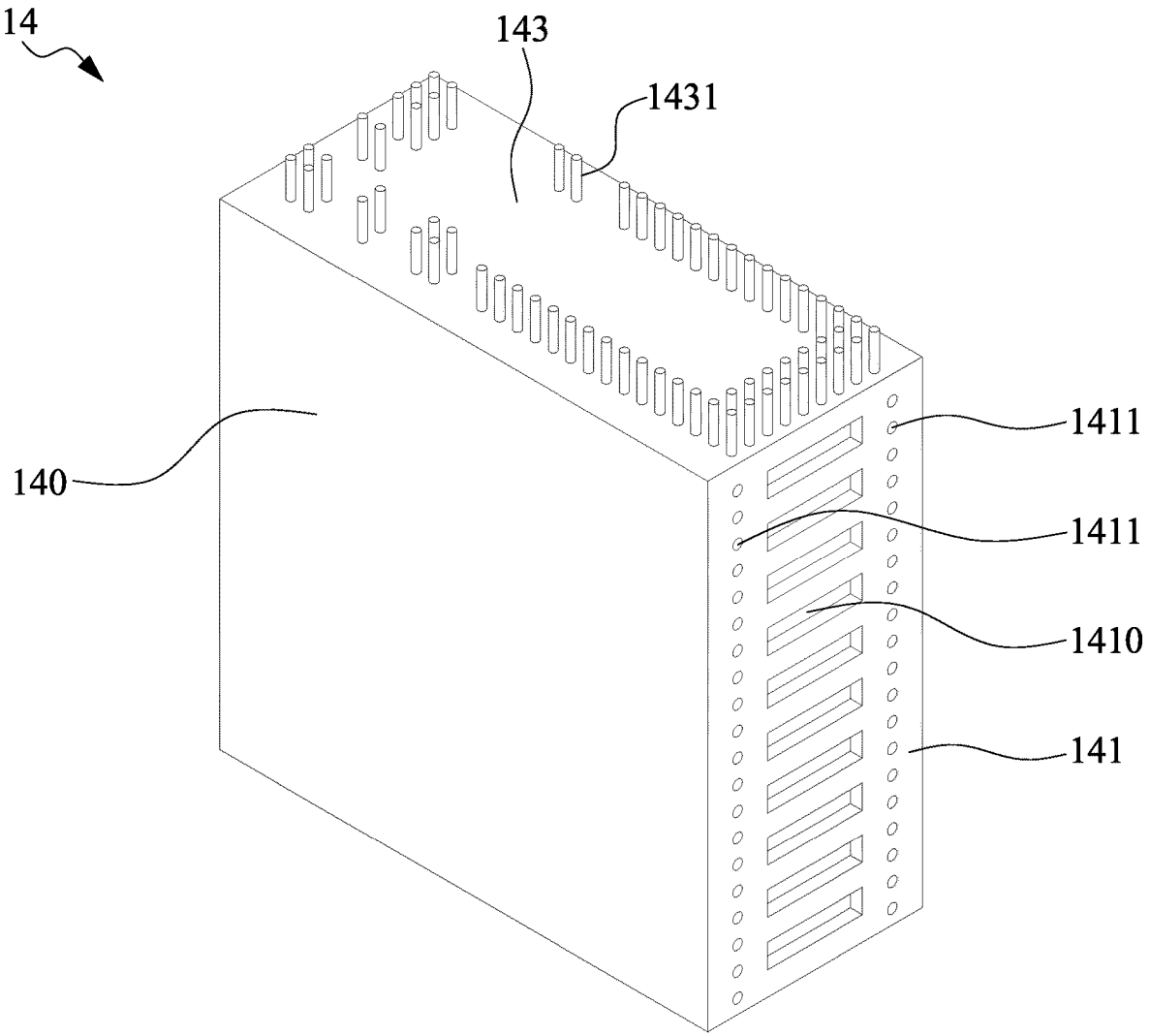
FIG. 2 is a schematic perspective view of a fiducial structure for constructing shear walls in accordance with another embodiment of the present disclosure.

FIG. 2 is a schematic perspective view of a fiducial structure 2 for constructing shear walls in accordance with another embodiment of the present disclosure. Referring to FIG. 2, the fiducial structure 14 has a main body 140, and it is precast in a factory before being transported to the construction site.

The main body 140 of the fiducial structure 14 has a side surface 141 configured to connect with one end of a shear wall. The side surface 141 of the fiducial structure 14 has a multiple of recesses 1410 arranged approximately along the height of the fiducial structure 14. The recesses 1410 are configured to provide more contact area between the shear wall and the side surface 141 of the fiducial structure 14. In addition, a multiple of rebar couplers 1411 may be embedded within the main body 140 and positioned adjacent to the recesses 1410 of the fiducial structure 14, and the rebar couplers 1411 may be generally arranged along the height of the fiducial structure 14 and disposed at both lateral sides of the side surface 141 of the fiducial structure 14. In some embodiments of the present disclosure, the structure of the rebar coupler 1411 embedded in the main body 140 of the fiducial structure 14 may be similar to or the same as the rebar coupler 1111 embedded in the free end 111 of the first guide portion 11 of the fiducial structure 1 or similar to or the same as the rebar coupler 1211 embedded in the free end 121 of the second guide portion 11 of the fiducial structure 1. The rebar coupler 1411 embedded in the main body 140 of the fiducial structure 14 may have an end portion having internal threads (not shown) and exposed on the side surface 141 of the fiducial structure 14 and may have a T-shaped structure or an expansion anchoring structure positioned opposite to that end portion. The rebar couplers 1411 are configured to connect the steel bars of the shear wall.

In addition, the upper surface 143 of the fiducial structure 14 may protrude with multiple steel bars 1431, while the bottom of another fiducial structure 14 may be embedded with multiple rebar couplers (not shown). The structure of the rebar couplers embedded in the bottom of the fiducial structure 14 may be similar or identical to the structure of the rebar coupler 171 embedded in the bottom of the upper fiducial structure 1*a* (see FIG. 1C). In some embodiments, two identical or similar fiducial structures 14 may be stacked vertically, the steel bars 1431 protruding from the upper surface 143 of the lower fiducial structure 14 may connect with the rebar couplers embedded in the bottom of the upper fiducial structure 14. With this arrangement, the overall height of the fiducial structures 14 could be adjusted as needed or required.

Figure 3A:
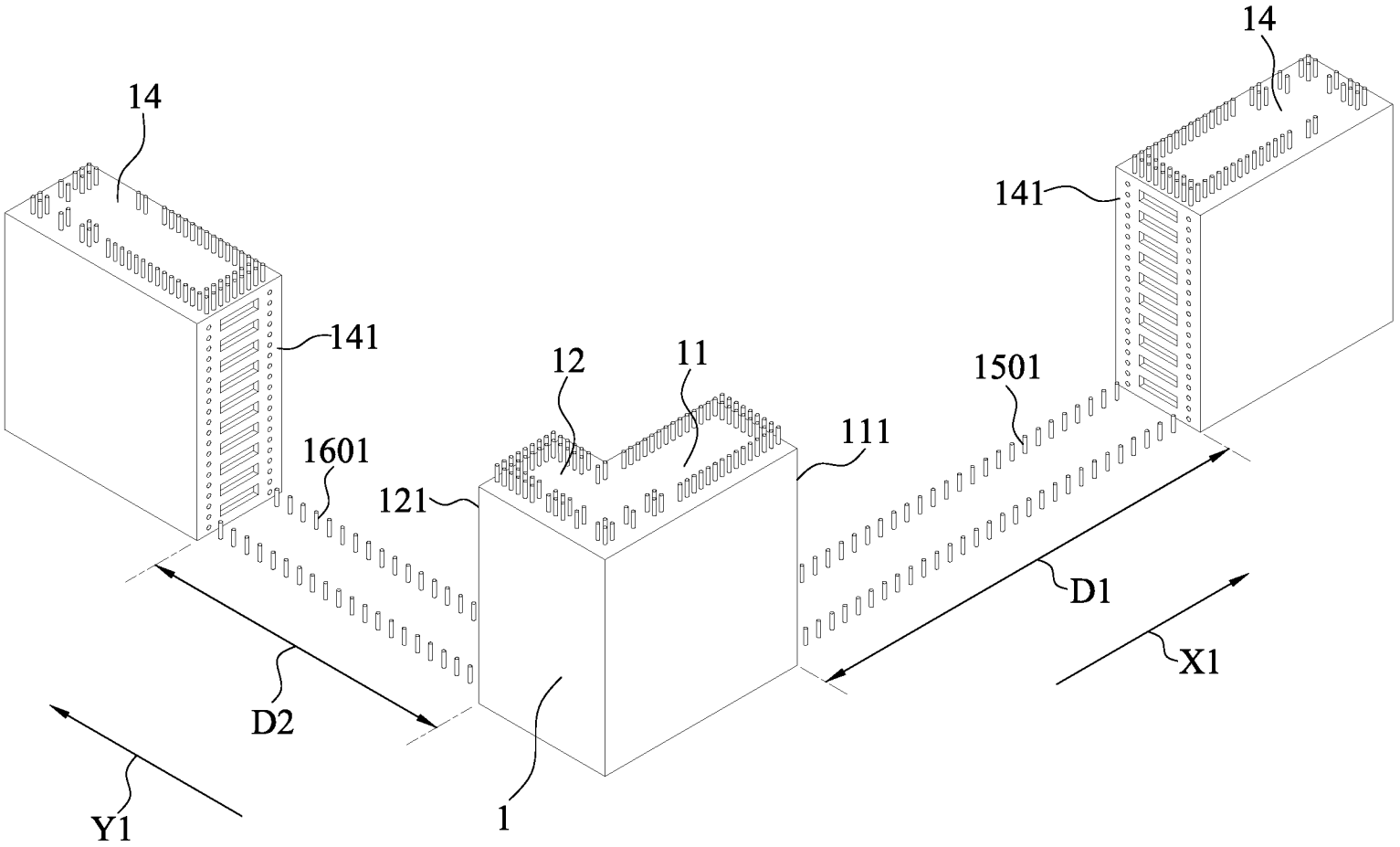
FIG. 3A is a first schematic view showing a first embodiment of the present disclosure.

FIG. 3A is a first schematic view showing a first embodiment of the present disclosure. As shown in FIG. 3A, the pre-cast fiducial structures 1 and 14 is provided on a construction site. The fiducial structure 1 is placed at a location that serves as a junction of two shear walls to be constructed. The fiducial structure 14 is positioned along the X1 direction, same as the extension direction of the first guide portion 11 of fiducial structure 1. There is a distance D1 between the free end 111 of the first guide portion 11 of fiducial structure 1 and the side 141 of fiducial structure 14. The side 141 of fiducial structure 14 faces toward the first guide portion 11 of fiducial structure 1. In addition, on the construction site between fiducial structures 1 and 14, there are multiple vertical steel bars 1501 arranged along the X1 direction. The vertical steel bars 1501 are for connecting steel bars at the bottom of a shear wall (not shown). Further, another fiducial structure 14 is positioned in the Y1 direction, same as the extension direction of the second guide portion 12 of fiducial structure 1. There is a distance D2 between the free end 121 of the second guide portion 12 of fiducial structure 1 and the side 141 of said another fiducial structure 14. The side 141 of said another fiducial structure 14 faces toward the second guide portion 12 of fiducial structure 1. In addition, on the construction site between fiducial structures 1 and 14, there are multiple vertical steel bars 1601, arranged along the Y1 direction. These steel bars 1601 are used to connect with the steel bars at the bottom of the shear wall that will be installed on them.

Figure 3B:
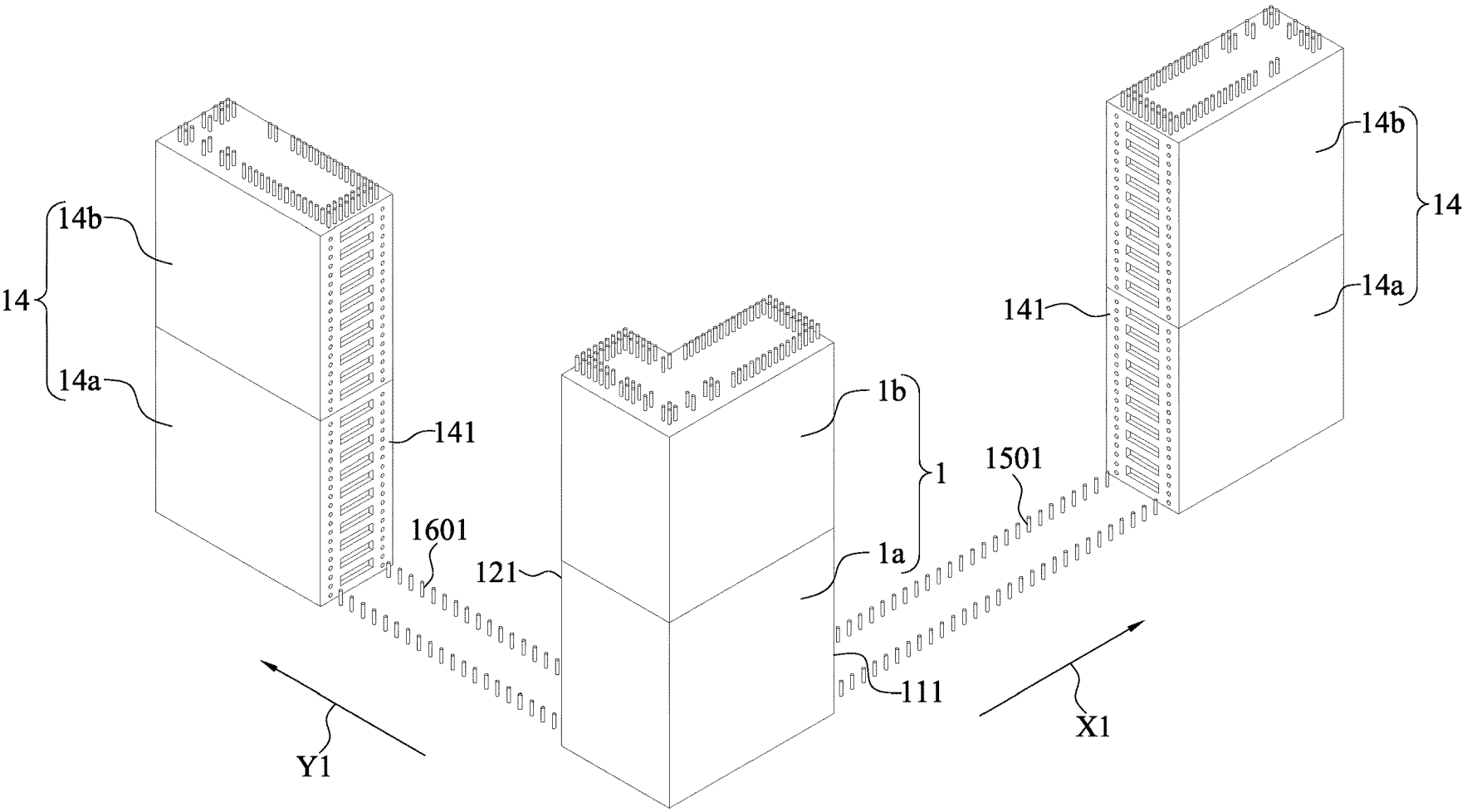
FIG. 3B is a second schematic view showing the first embodiment of the present disclosure.

FIG. 3B is a second schematic view showing the first embodiment of the present disclosure. As shown in FIG. 3B, another fiducial structure 1*b* is stacked on the fiducial structure 1*a* that was already provided on the construction site. As above mentioned, when two identical or similar fiducial structures 1*a*, 1*b* are stacked, the steel bars 131 on the upper surface 13 of the lower fiducial structure 1*a* are aligned with the rebar couplers 171 embedded at the bottom of the upper fiducial structure 1*b*. Further, another fiducial structure 14*b* may be stacked on the fiducial structure 14*a* that was already provided on the construction site. As above mentioned, when two identical or similar fiducial structures 14*a*, 14*b* are stacked, the steel bars 1431 on the upper surface 143 of the lower fiducial structure 14*a* are aligned with the rebar couplers embedded at the bottom of the upper fiducial structure 14*b*.

Figure 3C:
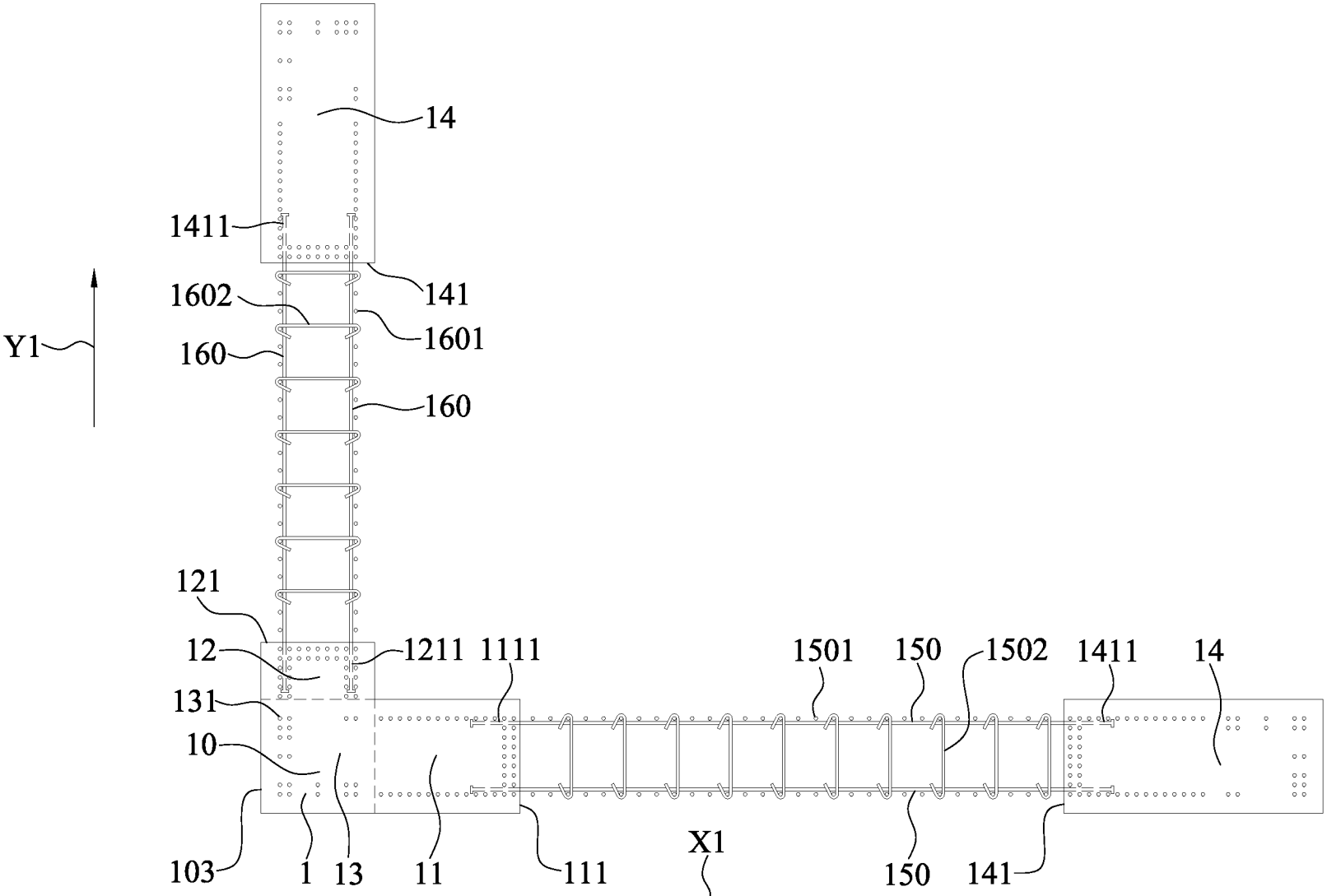
FIG. 3C is a third schematic view showing the first embodiment of the present disclosure.

FIG. 3C is a third schematic view showing the first embodiment of the present disclosure. As shown in FIG. 3C, on the construction site, two steel meshes 150 are provided. The steel meshes 150 are placed between the first guide portion 11 of the fiducial structure 1 and the fiducial structure 14. The two steel meshes 150 extend approximately in the X1 direction and are substantially parallel to each other. The bottom sides of the two steel meshes 150 are connected to the steel bars 1501 fixed to the ground (as shown in FIG. 3A and FIG. 3B). One side of the steel meshes 150 are connected to the rebar couplers 1111 of the first guide portion 11 of the fiducial structure 1. In some embodiments of the present disclosure, the ends of the transverse steel bars in the steel meshes 150 have external threads configured to connect with the internal threads of the end portion 1112 of the rebar couplers 1111 in the first guide portion 11. The opposing ends of the transverse steel bars in the steel meshes 150 may also have external threads for connecting with the internal threads of the rebar couplers 1411 in the fiducial structure 14. In addition, a multiple of tie bars 1502 are provided between the two steel meshes 150 and the tie bars 1502 are configured to connect and fix the two steel meshes 150 together.

Further, referring to FIG. 3C, on the construction site, two steel meshes 160 are provided on the construction site. The steel meshes 160 are placed between the second guide portion 21 of the fiducial structure 1 and the fiducial structure 14. The two steel meshes 160 extend approximately in the Y1 direction and are substantially parallel to each other. The bottom sides of the two steel meshes 160 are connected to the steel bars 1601 fixed to the ground (as shown in FIG. 3A and FIG. 3B). One side of the steel meshes 160 are connected to the rebar couplers 1211 of the second guide portion 12 of the fiducial structure 1. In some embodiments of the present disclosure, the ends of the transverse steel bars in the steel meshes 160 have external threads configured to connect with the internal threads of the end portion 1212 of the rebar couplers 1211 in the second guide portion 12. The opposing ends of the transverse steel bars in the steel meshes 160 also have external threads for connecting with the internal threads of the rebar coupler 1411 in the fiducial structure 14. In addition, a multiple of tie bars 1602 are provided between the two steel meshes 160 and the tie bars 1602 are configured to connect and fix the two steel meshes 160 together.

Figure 3D:
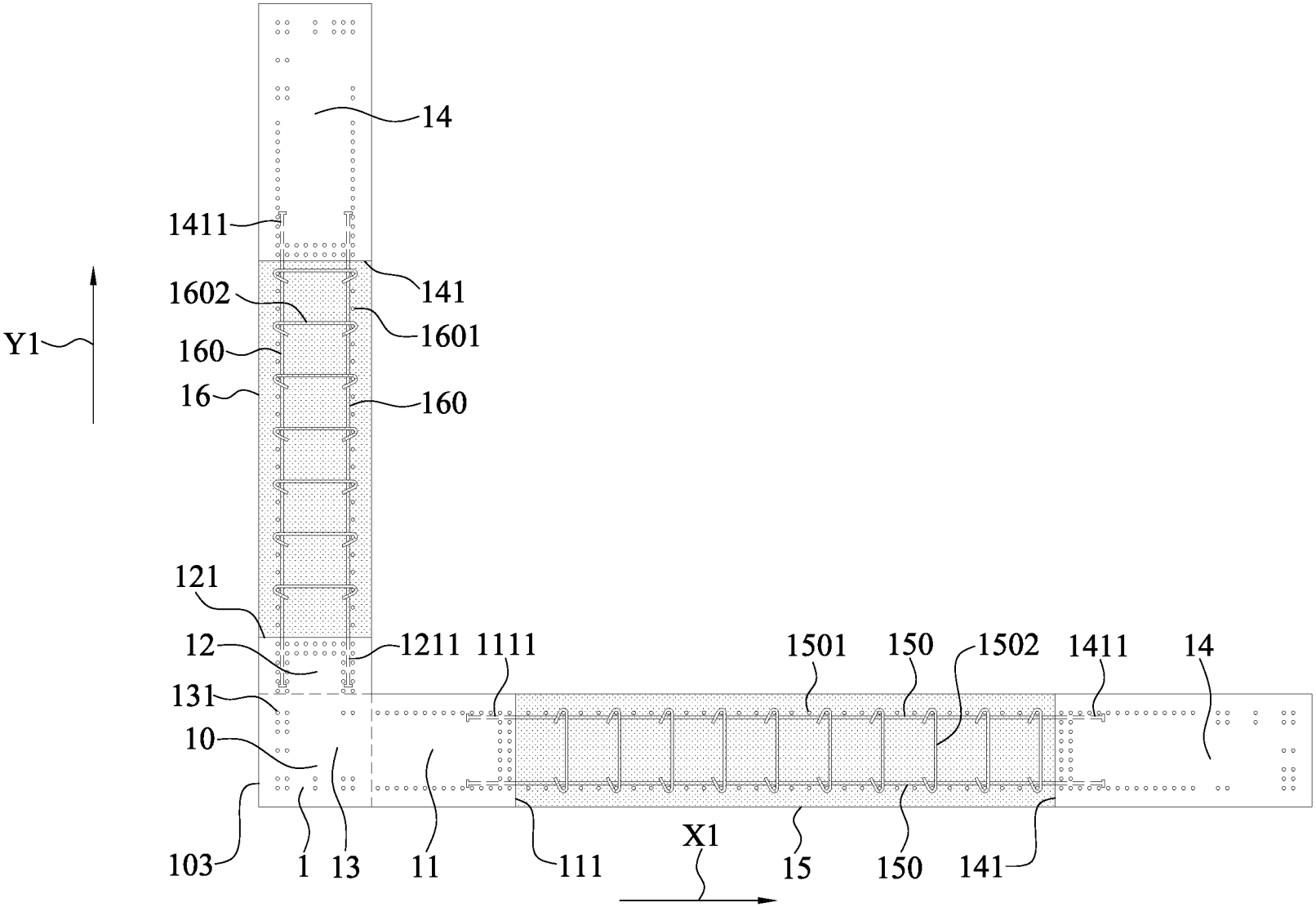
FIG. 3D is a fourth schematic view showing the first embodiment of the present disclosure.

FIG. 3D is a fourth schematic view showing the first embodiment of the present disclosure. As shown in FIG. 3D, concrete is poured into the formwork (not shown) provided on both sides of the steel meshes 150 for constructing the shear wall 15. According to the above-described method, the shear wall 15 is positioned by the fiducial structures 1 and 14 and oriented along the X1 direction by the first guide portion 11 of fiducial structure 1.

Moreover, referring to FIG. 3D, concrete is poured into the formwork (not shown) provided on both sides of the steel meshes 160 for constructing the shear wall 16. According to the above-described method, the shear wall 16 is positioned by the fiducial structures 1 and 14 and oriented along the Y1 direction by the second guide portion 12 of fiducial structure 1.

As shown in FIG. 3D, the shear wall 15 and shear wall 16 are interconnected through fiducial structure 1 and extend along the X1 and Y1 directions, respectively, resulting from the guides provided by the first guide portion 11 and the second guide portion 12 of fiducial structure 1. In some embodiments of the present disclosure, the extension direction of shear wall 15 (i.e., X1 direction) and the extension direction of shear wall 16 (i.e., Y1 direction) are approximately perpendicular to each other.

Figure 3E:
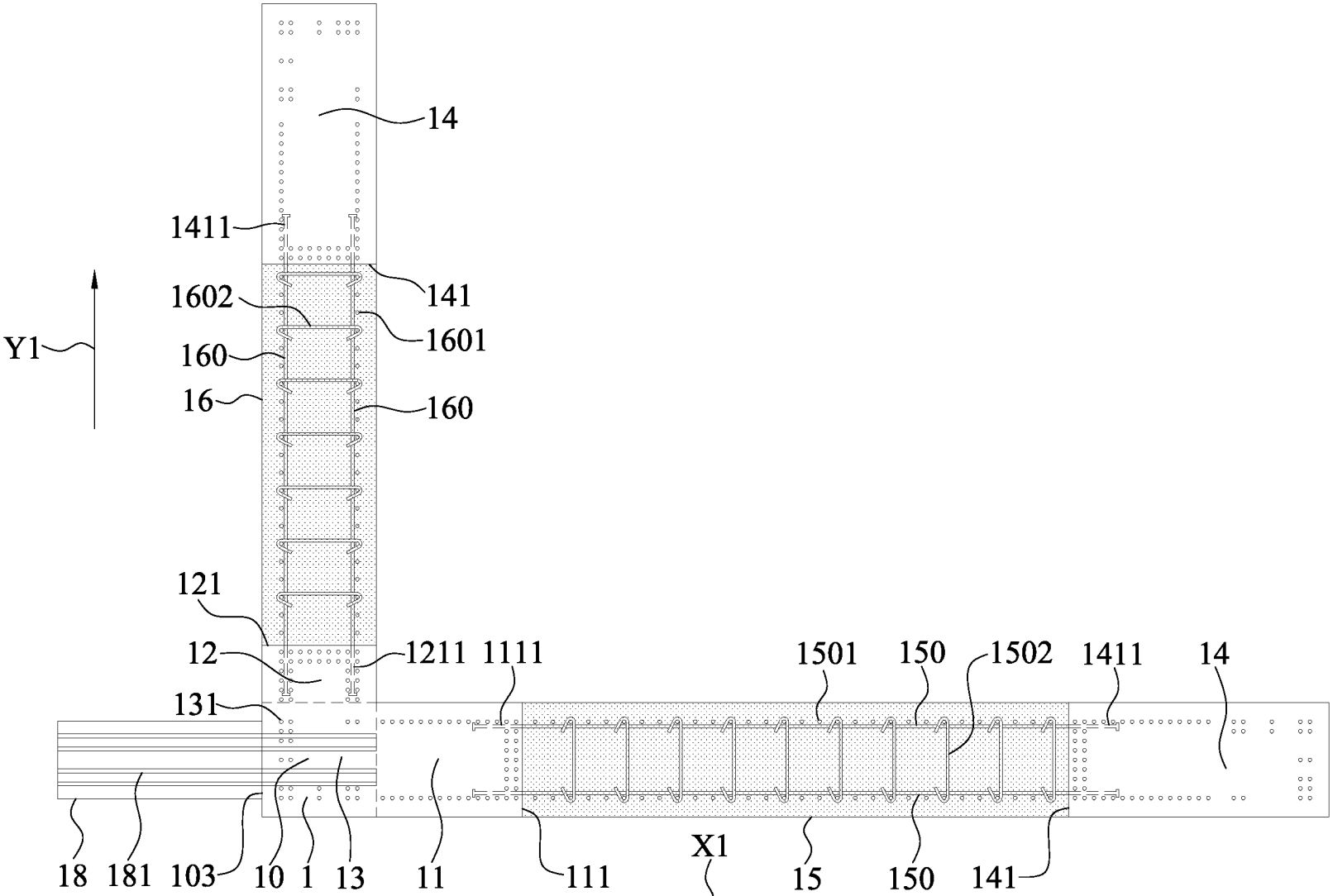
FIG. 3E is a fifth schematic view showing the first embodiment of the present disclosure.

FIG. 3E is a fifth schematic view showing the first embodiment of the present disclosure. As shown in FIG. 3E, a precast beam 18 extend outward from a side 103 of the fiducial structure 1. The transverse reinforcement bars 181 of the precast beam 18 are connected to the rebars on an upper surface 13 of the fiducial structure 1. Since the middle portion 10 of the fiducial structure 1 is prefabricated, the positions of the steel bars 131 on the upper surface 13 of the fiducial structure 1 can be precisely pre-determined at specific locations, taking into account the positions of the transverse reinforcement bars 181 of the precast beam 18 in advance. Accordingly, when the precast beam 18 is connected to the rebars on the top of the fiducial structure 1, the portions of the transverse reinforcement bars 181 of the precast beam 18 that are on the upper surface 13 of the fiducial structure 1 will not interfere with the steel bars 131 on the upper surface 13 of the fiducial structure 1.

Figure 4A:
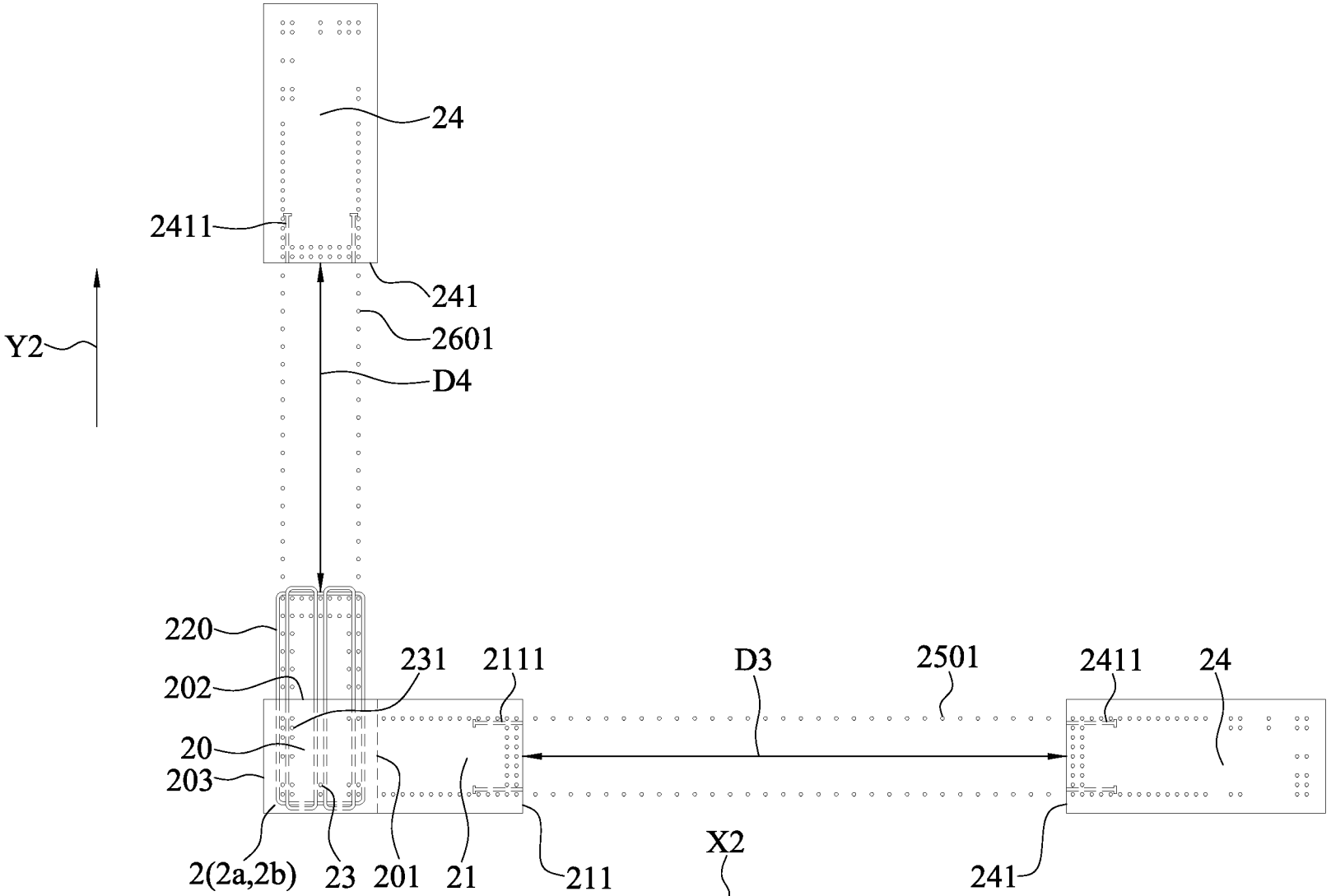
FIG. 4A is a first schematic view showing a second embodiment of the present disclosure.

FIG. 4A is a first schematic view showing a second embodiment of the present disclosure. As shown in FIG. 4A, a fiducial structure 2 is provided on a construction site. The fiducial structure 2 includes a middle portion 20 and a first guide portion 21. The first guide portion 21 extends from one side 201 of the middle portion 20 in the X2 direction. The middle portion 20 and the first guide portion 21 are precast together in a factory, forming a unitary unit, and subsequently transported to the construction site for installation.

Referring to FIG. 4A, the first guide portion 21 has a free end 211 that is away from the middle portion 20. In some embodiments of the present disclosure, the structure of the first guide portion 21 of fiducial structure 2 is the same or similar to the first guide portion 11 of fiducial structure 1 in the first embodiment. For example, the free end 211 of the first guide portion 21 includes multiple recesses (not shown) arranged along the height of the fiducial structure 2, and these recesses are the same or similar to the recesses 1110 on the free end 111 of the first guide portion 11 of fiducial structure 1. In some embodiments, the free end 211 of the first guide portion 21 are embedded with multiple rebar couplers 2111, and the rebar couplers 2111 may be the same or similar to the rebar couplers 1111 embedded at the free end 111 of the first guide portion 11 of fiducial structure 1.

In the second embodiment, multiple steel bars 231 protrude from an upper surface 23 of a lower fiducial structure 2*b*, while the bottom of the upper fiducial structure 2*a* may be embedded with multiple rebar couplers (not shown). In some embodiments of the present disclosure, the protruding steel bars 231 on the upper surface 23 of fiducial structure 2 are the same or similar to the steel bars 131 on the upper surface 13 of fiducial structure 1 in the first embodiment, and the rebar couplers embedded in the bottom of the upper fiducial structure 2*a* may be the same or similar to the rebar couplers 171 embedded in the bottom of the upper fiducial structure 1*a* in the first embodiment.

Moreover, in the second embodiment, multiple steel bars 220 protrude from a side surface 202 of the fiducial structure 2 and extend approximately in the direction Y2. The side surface 202 is adjacent to the side 201 of the middle portion 20. In some embodiments of the present disclosure, the direction Y2 and the extension direction of the first guide portion 11 (i.e., direction X2) are perpendicular to each other.

Referring to FIG. 4A again, two precast fiducial structures 24 are provided on the construction site and they have similar or identical structures to fiducial structures 14 in the first embodiment. One of the fiducial structures 24 is positioned in the X2 direction, and is in line with the first guide portion 21 of fiducial 2. There is a distance D3 between the side 241 of the fiducial structure 24 and the free end 211 of the first guide portion 21 of fiducial structure 2. The side 241 of fiducial structure 24 face toward the first guide portion 21 of fiducial structure 2. In addition, multiple vertical steel bars 2501 are installed on the construction site between fiducial structures 2 and 24. These steel bars 2501 are arranged along the X2 direction, and they are configured to be connected to the steel bars of the shear wall that will be later installed on them.

Moreover, the other one of the fiducial structures 24 is positioned in the Y2 direction, with the side 202 of the middle portion 20 of the fiducial structure 2 facing toward said the other one of the fiducial structures 24. There is a distance D4 between the side 241 of the fiducial structure 24 and the steel bars 220 of the fiducial structure 2. In addition, multiple vertical steel bars 2601 are installed on the construction site between fiducial structures 2 and 24. These steel bars 2601 are substantially arranged along the Y2 direction, and they are configured to be connected to the steel bars at the bottom of the shear walls that will be later installed on them.

Figure 4B:
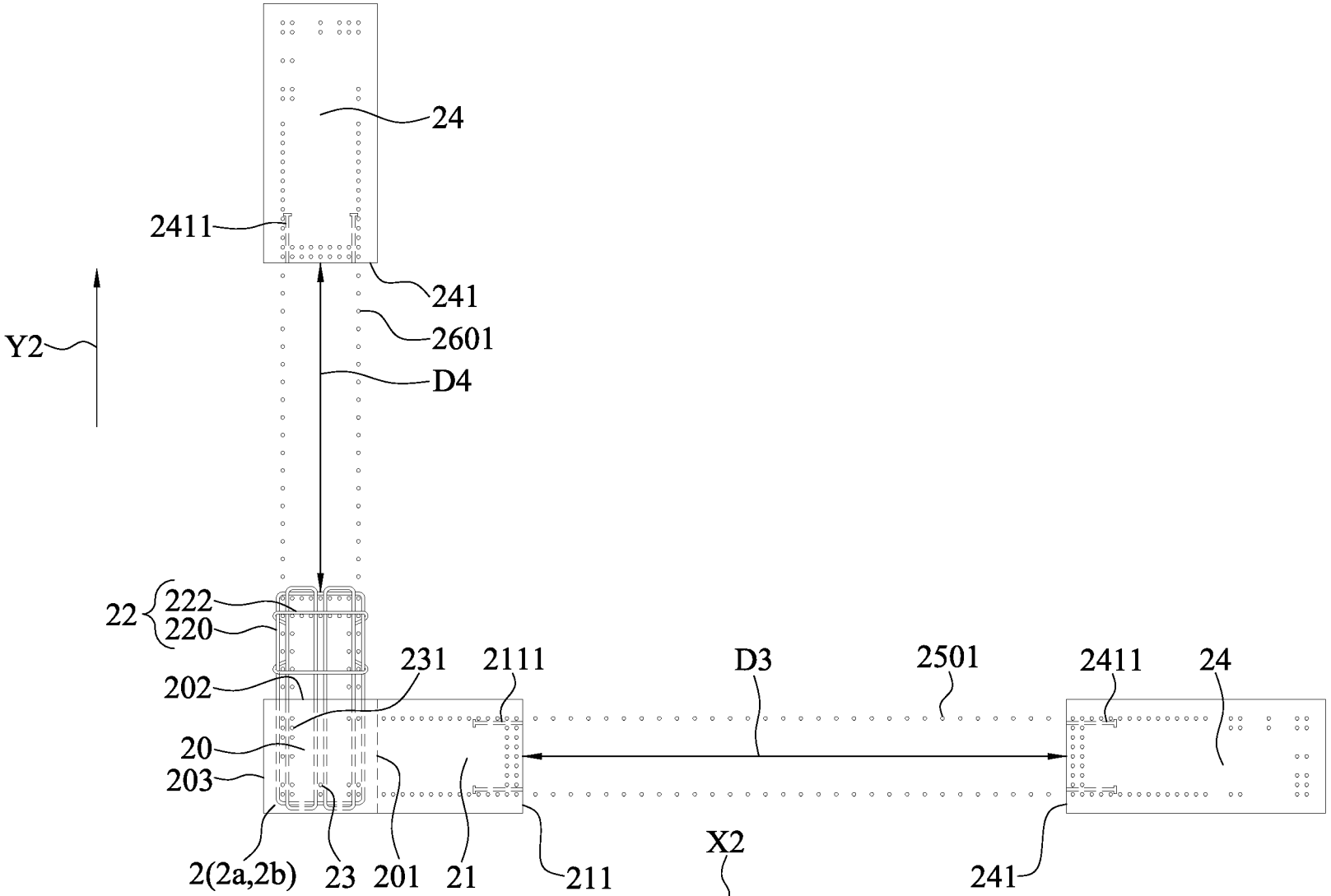
FIG. 4B is a second schematic view showing the second embodiment of the present disclosure.

FIG. 4B is a second schematic view showing the second embodiment of the present disclosure. As shown in FIG. 4B, multiple tie bars 222 are provided and tied to the steel bars 220 protruding from the side surface 202 of the fiducial structure 2 so that they together form the steel bars for the second guide portion 22 of the fiducial structure 2. After concrete is poured into the form boards surrounding them and solidified, the second guide portion 22 of fiducial structure 2 is completed on the construction site. As shown in FIG. 4B, the second guide portion 22 extends approximately along the Y2 direction from the side 202 of the middle portion 20. In some embodiments of the present disclosure, a length of the first guide portion 21 is greater than a length of the second guide portion 22.

Figure 4C:
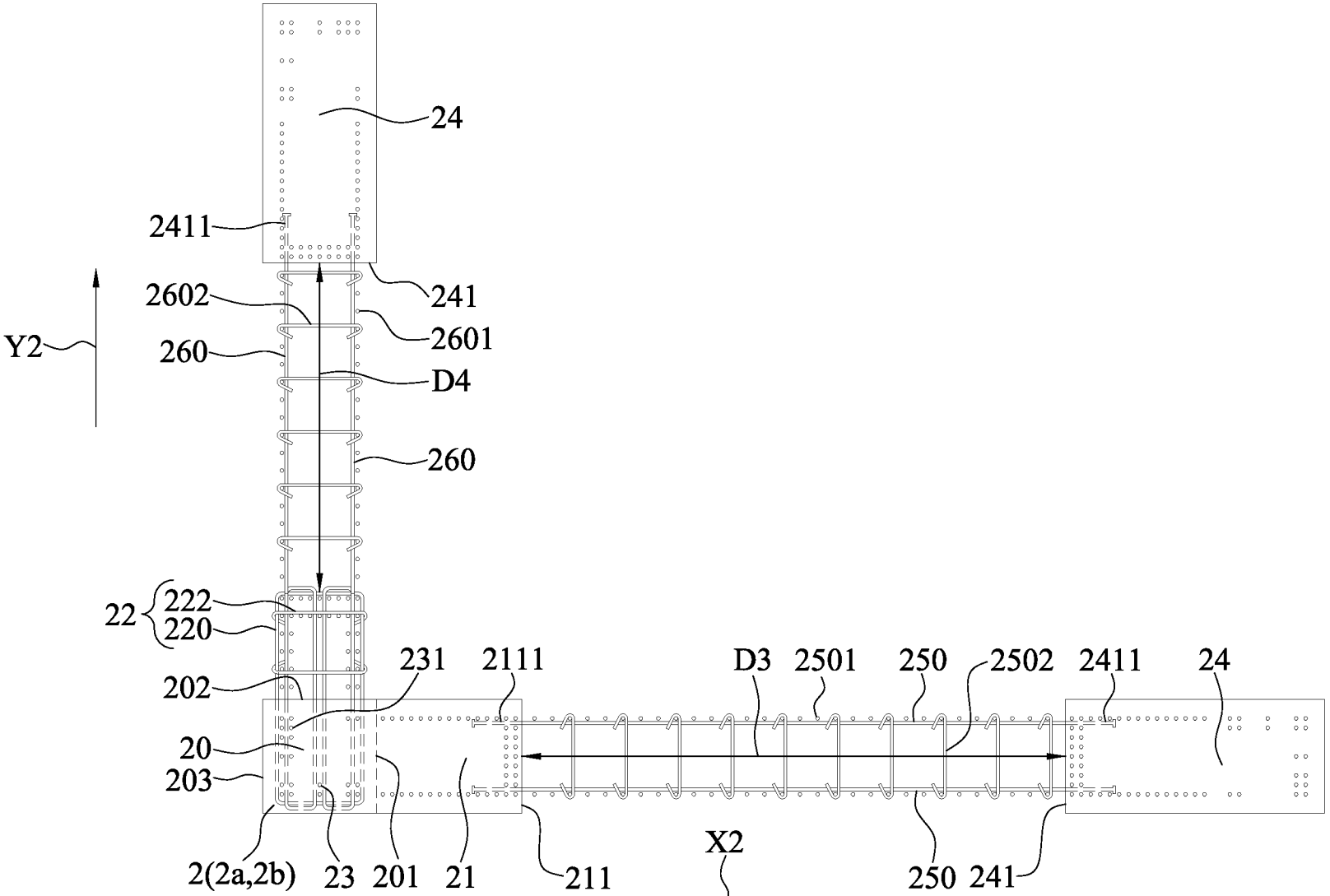
FIG. 4C is a third schematic view showing the second embodiment of the present disclosure.

FIG. 4C is a third schematic view showing the second embodiment of the present disclosure. As shown in FIG. 4C, on the construction site, two steel meshes 250 are provided. The steel meshes 250 are placed between the first guide portion 21 of the fiducial structure 2 and the fiducial structure 24. They extend approximately in the X2 direction and are substantially parallel to each other. The bottom sides of the two steel meshes 250 are to be connected to the steel bars 2501 fixed to the ground (as shown in FIG. 4A and FIG. 4B). The outer threaded ends of the transverse steel bars on one side of the steel mesh 250 are connected to the inner threaded ends of the rebar couplers 2111 on the end of the first guide portion 21 of the fiducial structure 2. Further, the outer threaded ends of the transverse steel bars on the other side of the steel mesh 250 are connected to the inner threaded ends of the rebar couplers 2411 on the end of the fiducial structure 24. In addition, a multiple of tie bars 2502 are provided between the two steel meshes 250 and the tie bars 2502 are configured to connect and fix the two steel meshes 250 together.

Referring to FIG. 4C again, on the construction site, two steel meshes 260 are provided. The steel meshes 260 are placed between the second guide portion 22 of the fiducial structure 2 and the fiducial structure 24. They extend approximately in the Y2 direction and are substantially parallel to each other. The bottom sides of the two steel meshes 260 are to be connected to the steel bars 2601 fixed to the ground (as shown in FIG. 4A and FIG. 4B). The outer threaded ends of the transverse steel bars on one side of the steel mesh 260 may be connected to the steel bars 220 of the second guide portion 22 of fiducial structure 2. Further, the outer threaded ends of the transverse steel bars on the other side of the steel mesh 260 may be connected to the inner threaded ends of the rebar couplers 2411 on the end of the fiducial structure 24. In addition, a multiple of tie bars 2602 may be provided between the two steel meshes 260 and the tie bars 2602 are configured to connect and fix the two steel meshes 260 together.

Figure 4D:
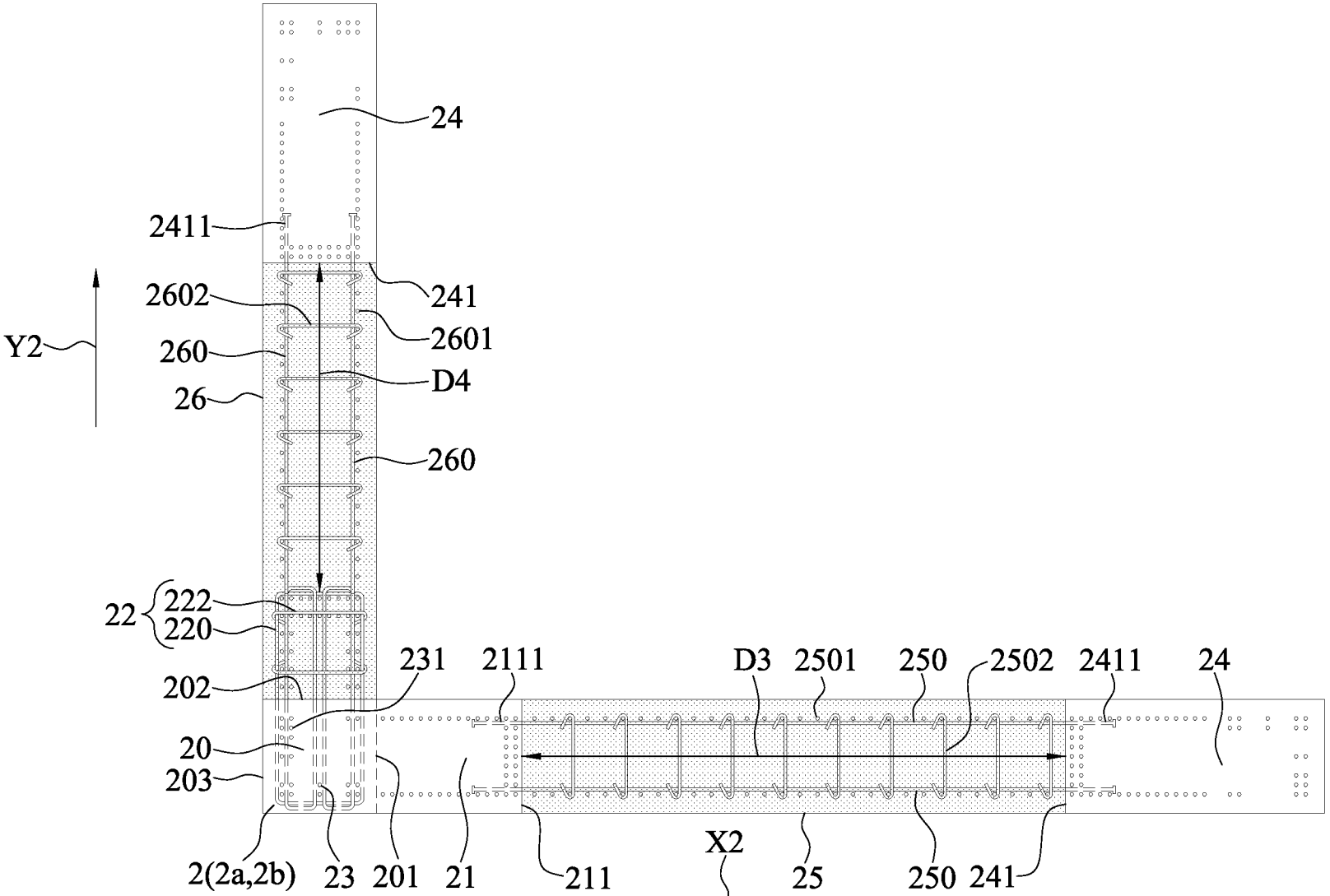
FIG. 4D is a fourth schematic view showing the second embodiment of the present disclosure.

FIG. 4D is a fourth schematic view showing the second embodiment of the present disclosure. As shown in FIG. 4D, concrete is poured into the formwork (not shown) provided on both sides of the steel meshes 250 for constructing the shear wall 25. As above-mentioned, the shear wall 25 is positioned by the fiducial structures 2 and 24 and oriented along the X2 direction by the first guide portion 21 of fiducial structure 2.

Moreover, referring to FIG. 4D, concrete is poured into the formwork (not shown) provided on both sides of the steel meshes 260 to construct the shear wall 26. As above-mentioned, the shear wall 26 may be positioned by the fiducial structures 2 and 24 and guided along the Y2 direction by the second guide portion 22 of fiducial structure 2.

As shown in FIG. 4D, the shear wall 25 and shear wall 26 are interconnected through fiducial structure 2 and extend along the X2 and Y2 directions, respectively, resulting from the guide provided by the first guide portion 21 and the second guide portion 22 of fiducial structure 2. In some embodiments of the present disclosure, the extension direction (i.e., X2) of shear wall 25 and the extension direction (i.e., Y2) of shear wall 26 are approximately perpendicular to each other.

Figure 4E:
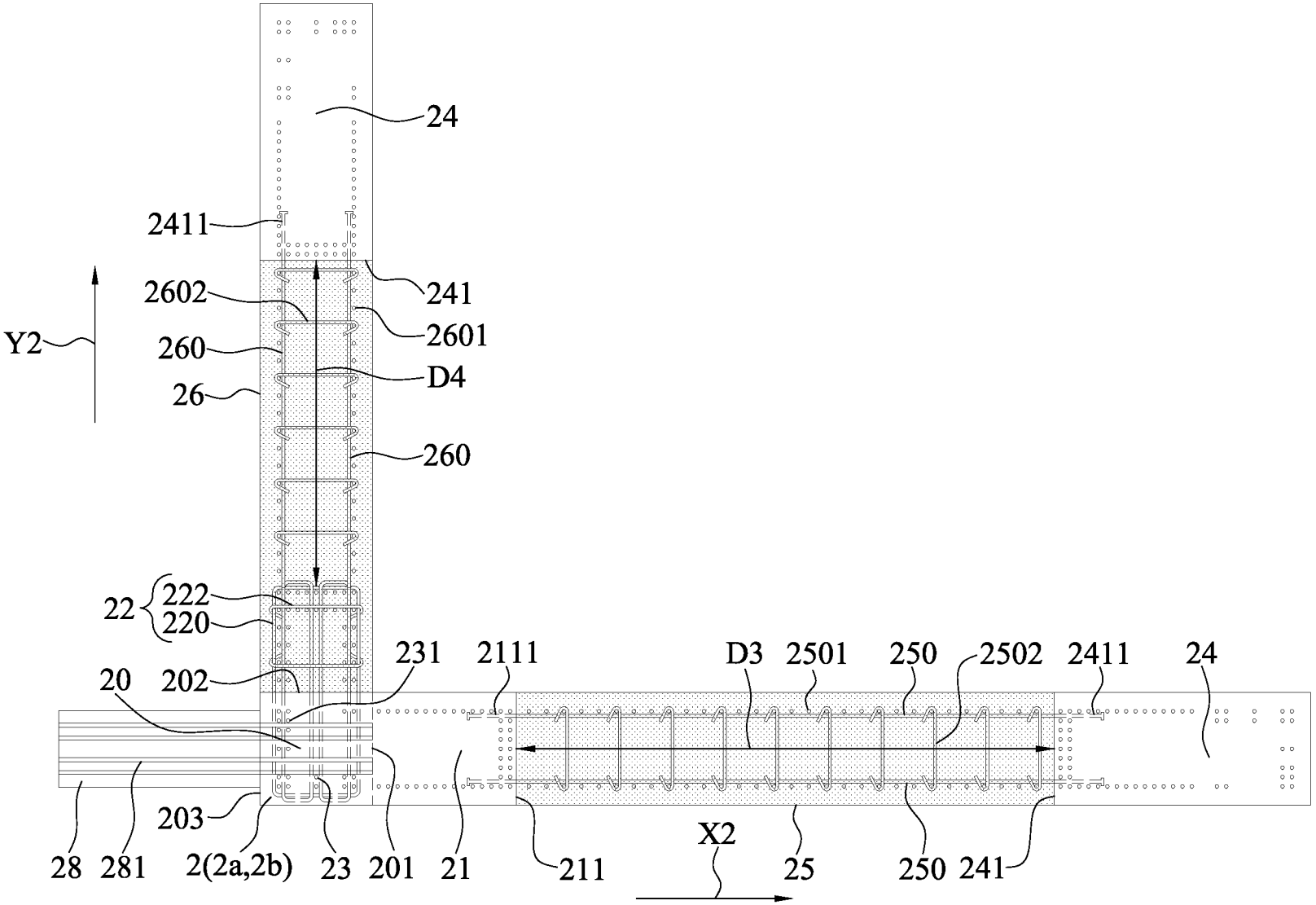
FIG. 4E is a fifth schematic view showing the second embodiment of the present disclosure.

FIG. 4E is a fifth schematic view showing the second embodiment of the present disclosure. As shown in FIG. 4E, a precast beam 28 extends outward from a side 203 of the fiducial structure 2. The transverse reinforcement bars 281 of the precast beam 28 are connected to the rebars placed on an upper surface 23 of the fiducial structure 2. Since the middle portion 20 of the fiducial structure 2 is prefabricated, the positions of the steel bars 231 on the upper surface 23 of the fiducial structure 2 can be precisely pre-determined at specific locations, taking into account the positions of the transverse reinforcement bars 281 of the precast beam 28 in advance. Accordingly, when the precast beam 28 is connected to the top of the fiducial structure 2, the portions of the transverse reinforcement bars 281 of the precast beam 28 that are on or above the upper surface 23 of the fiducial structure 2 will not interfere with the steel bars 231 on the upper surface 23 of the fiducial structure 2.

Figure 5A:
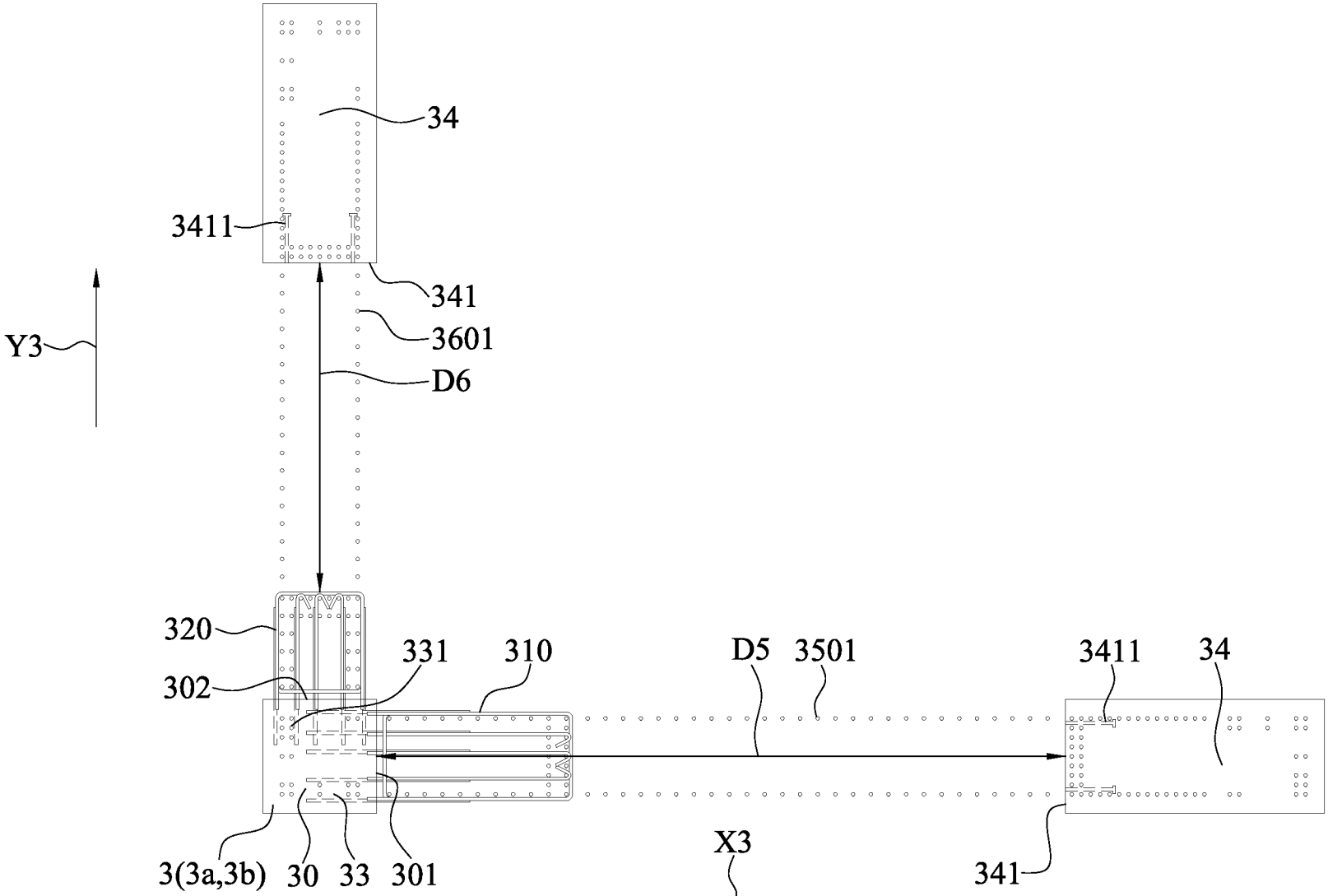
FIG. 5A is a first schematic view showing a third embodiment of the present disclosure.

FIG. 5A is a first schematic view showing a third embodiment of the present disclosure. As shown in FIG. 5A, a fiducial structure 3 is provided on a construction site. The fiducial structure 3 includes a middle portion 30. The middle portion 30, as a precast column, is precast in a factory and subsequently transported to the construction site.

In addition, in the third embodiment, multiple steel bars 331 protrude from an upper surface 33 of the lower fiducial structure 3*b*, while the bottom of the upper fiducial structure 3*a* may be embedded with multiple rebar couplers (not shown). In some embodiments of the present disclosure, the protruding steel bars 331 on the upper surface 33 of fiducial structure 2 may be the same or similar to the steel bars 131 on the upper surface 13 of fiducial structure 1 in the first embodiment, and the rebar couplers embedded in the bottom of the upper fiducial structure 3 may be the same or similar to the rebar couplers 171 embedded in the bottom of the upper fiducial structure 1 in the first embodiment.

Referring to FIG. 5A, multiple steel bars 310 protrude from a side surface 301 of the fiducial structure 3. In some embodiments of the present disclosure, the side surface 301 of the middle portion 30 is oriented approximately in the direction X3. Further, multiple steel bars 320 protrude from a side surface 302 of the fiducial structure 3. The side surface 302 is adjacent to the side surface 301 of the fiducial structure 3. In some embodiments of the present disclosure, the multiple steel bars 320 of the middle portion 30 are oriented approximately in the direction Y3. In some embodiments of the present disclosure, the side surface 302 is perpendicular to the side surface 301.

Referring to FIG. 5A again, two precast fiducial structures 34 are provided on the construction site and they have similar or identical structures to the fiducial structures 14 in the first embodiment. As shown in FIG. 5A, one of the fiducial structures 34 is positioned in the X3 direction, with the side surface 301 of the middle portion 30 of the fiducial structure 3 faces toward the precast fiducial structures 34. The fiducial structure 34 is approximately located at a distance D5 from the steel bars 310 of the fiducial structure 3. The side 341 of fiducial structure 34 substantially faces the side surface 301 of fiducial structure 3. In addition, multiple vertical steel bars 3501 are installed on the construction site between fiducial structures 3 and 34. These steel bars 3501 are substantially arranged along the X3 direction, and they are configured to be connected to the steel bars of the shear walls that will be later installed on them.

Moreover, the other one of the fiducial structures 34 may be positioned in the Y3 direction. The multiple steel bars 320 of the middle portion 30 of the fiducial structure 3 extends in the Y3 direction. The fiducial structure 34 is approximately located at a distance of D6 from the steel bars 320 of the fiducial structure 3. The side 341 of said the other fiducial structure 34 substantially face the side surface 302 of fiducial structure 3. In addition, multiple vertical steel bars 3601 are installed on the construction site between fiducial structures 3 and 34. These steel bars 3601 are substantially arranged along the Y3 direction, and they are configured to be connected to the steel bars at the bottom of the shear walls that will be later installed on them.

Figure 5B:
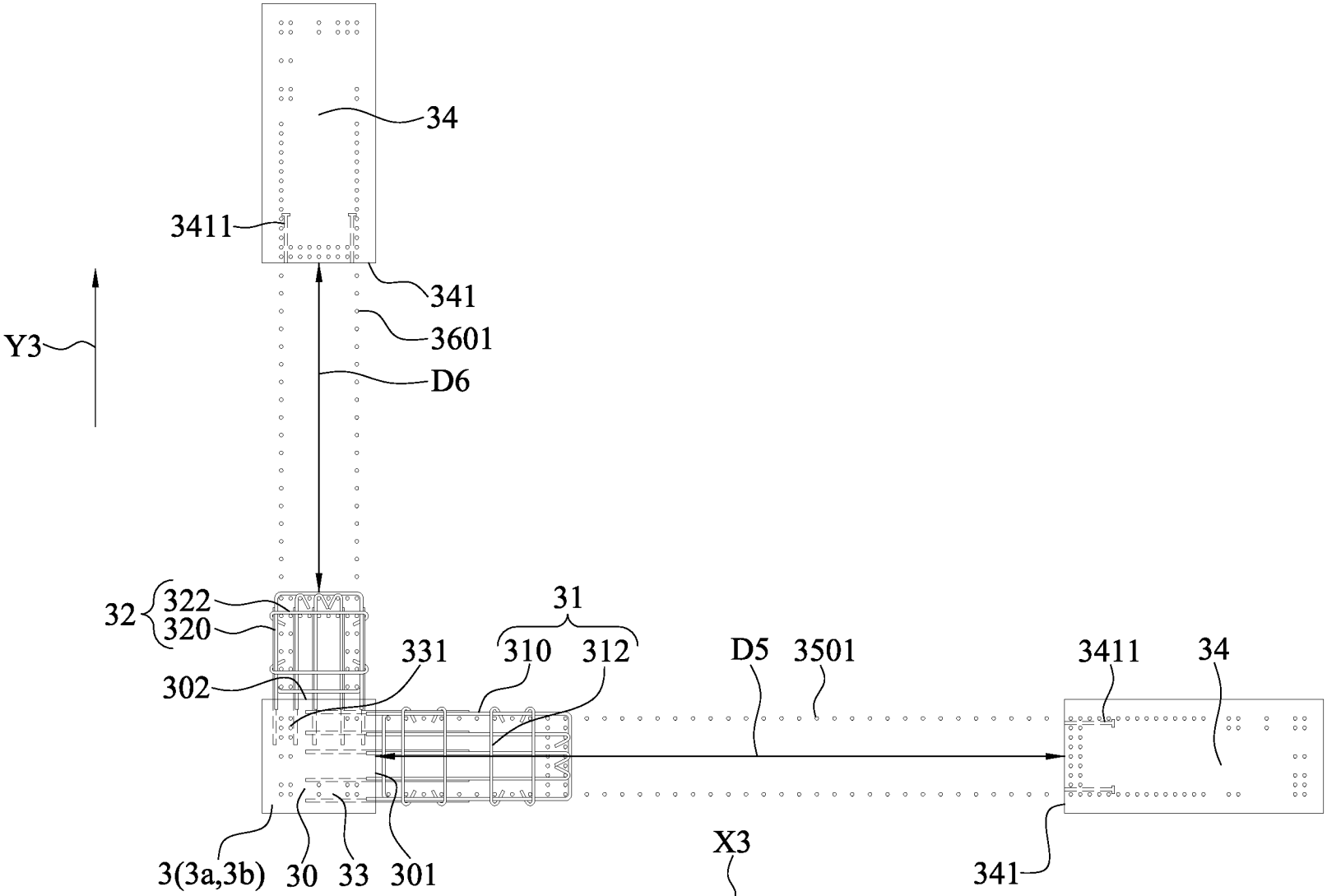
FIG. 5B is a second schematic view showing the third embodiment of the present disclosure.

FIG. 5B is a second schematic view showing the third embodiment of the present disclosure. As shown in FIG. 5B, multiple tie bars 312 may be provided and tied to the steel bars 310. The steel bars 310 and tie bars 312 after being tied together form the steel bars for the first guide portion 31 of the fiducial structure 3. Thus, the first guide portion 31 of fiducial structure 3 will be completed on the construction site after concrete is poured into the form boards surrounding them and is solidified. As shown in FIG. 5B, the first guide portion 31 extends approximately along the X3 direction from the side 301 of the middle portion 30. Further, multiple tie bars 322 may be provided and tied to the steel bars 320 and together they form the steel bars for the second guide portion 32 of the fiducial structure 3. Thus, the second guide portion 32 of fiducial structure 3 will be completed on the construction site after concrete is poured into the form boards surrounding them and is solidified. As shown in FIG. 5B, the second guide portion 22 extends approximately along the Y3 direction from the side 302 of the middle portion 30. In some embodiments of the present disclosure, a length of the first guide portion 31 is greater than a length of the second guide portion 32 or vice versa.

Figure 5C:
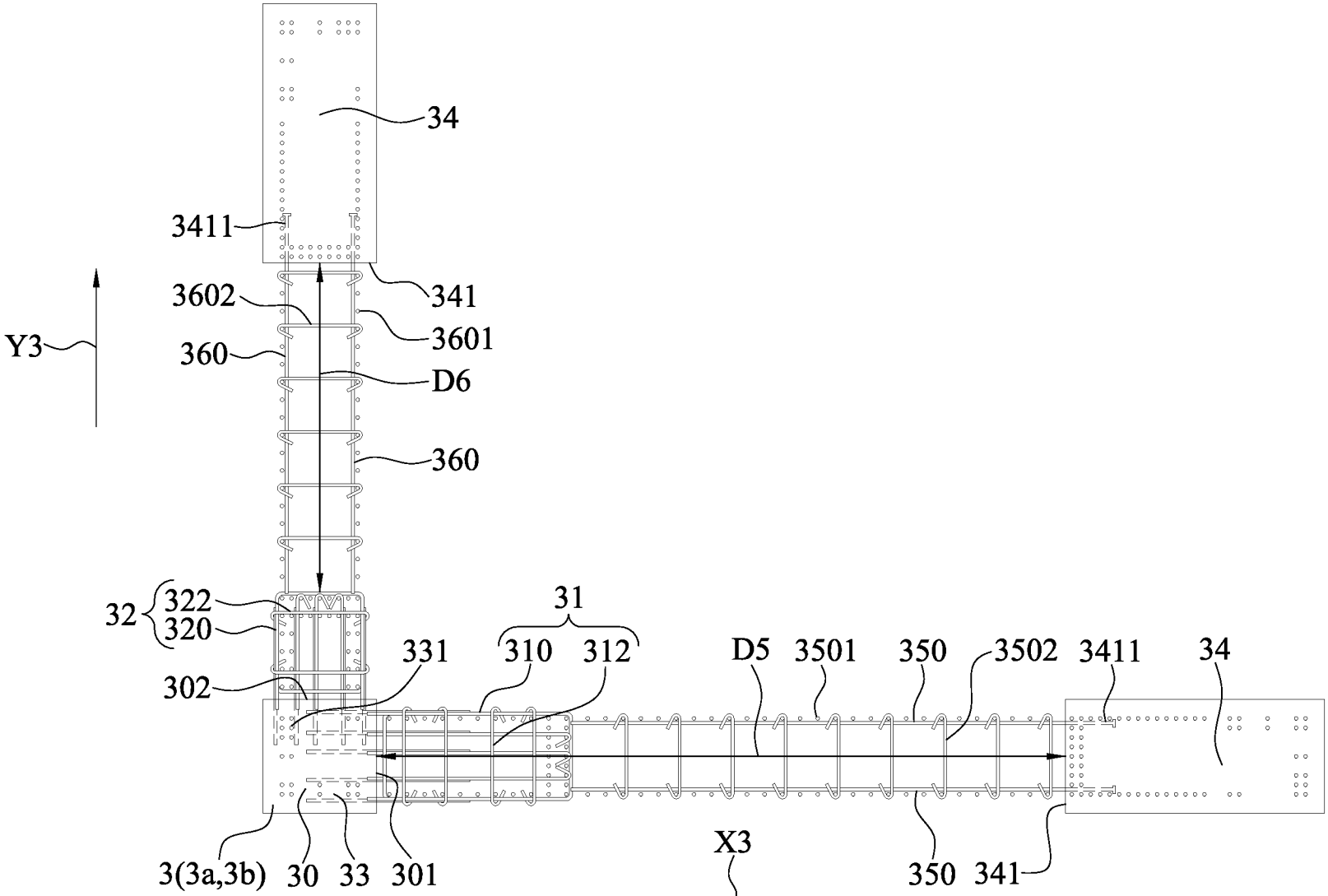
FIG. 5C is a third schematic view showing the third embodiment of the present disclosure.

FIG. 5C is a third schematic view showing the third embodiment of the present disclosure. As shown in FIG. 5C, on the construction site, two steel meshes 350 may be provided. The steel meshes 350 are placed between the first guide portion 31 of the fiducial structure 3 and the fiducial structure 34. The steel meshes 350 extend approximately in the X3 direction and are substantially parallel to each other. The bottom sides of the two steel meshes 350 are connected to the steel bars 3501 fixed to the ground (as shown in FIG. 5A and FIG. 5B). One side of the steel mesh 350 may be connected to the steel bars 310 of the first guide portion 31 of fiducial structure 3. The other side of the steel mesh 350 may be connected to the rebar couplers 3411 of the fiducial structure 34. In some embodiments of the present disclosure, the outer threaded end of the transverse reinforcement in steel mesh 350 is connected to the inner threaded end of the end portion of the rebar coupler 3411. In addition, a multiple of tie bars 3502 may be provided between the two steel meshes 350 and the tie bars 3502 are configured to connect and fix the two steel meshes 350 together.

Referring to FIG. 5C again, on the construction site, two steel meshes 360 may be provided. The steel meshes 360 may be placed between the first guide portion 32 of the fiducial structure 3 and the fiducial structure 34. They extend approximately in the Y3 direction and are substantially parallel to each other. The bottom sides of the two steel meshes 360 are connected to the steel bars 3601 fixed to the ground (as shown in FIG. 5A and FIG. 5B). One side of the steel mesh 360 may be connected to the steel bars 320 of the second guide portion 32 of fiducial structure 3. The other side of the steel mesh 360 may be connected to the rebar couplers 3411 of the fiducial structure 34. In some embodiments of the present disclosure, the outer threaded end of the transverse reinforcement in steel mesh 360 is connected to the inner threaded end of the end portion of the rebar coupler 3411. In addition, a multiple of tie bars 3602 may be provided between the two steel meshes 360 and the tie bars 3602 are configured to connect and fix the two steel meshes 360 together.

Figure 5D:
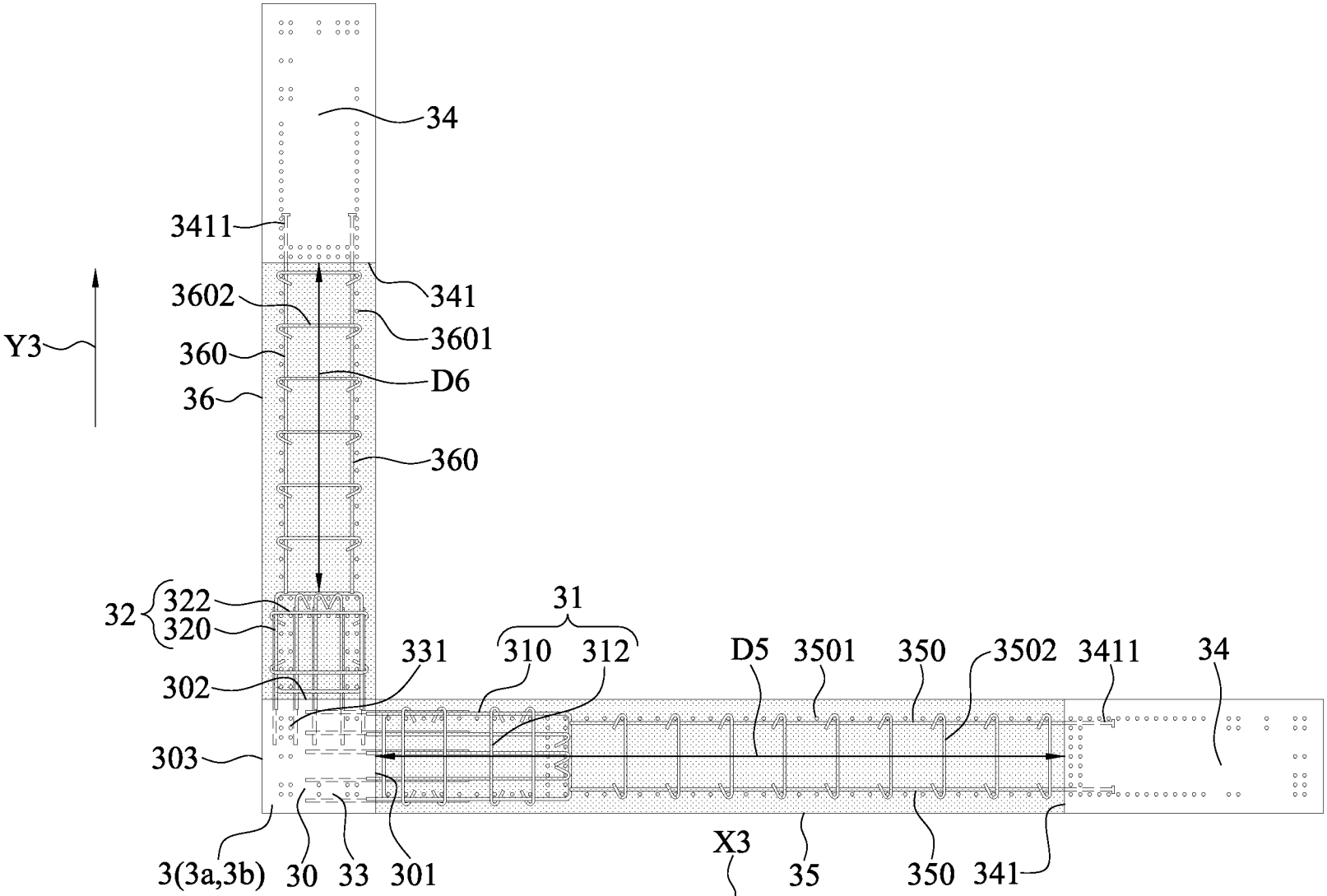
FIG. 5D is a fourth schematic view showing the third embodiment of the present disclosure.

FIG. 5D is a fourth schematic view showing the third embodiment of the present disclosure. As shown in FIG. 5D, concrete is poured into the formwork (not shown) provided on both sides of the steel meshes 350 for constructing the shear wall 35. According to the above procedures described, the shear wall 35 is positioned by the fiducial structures 3 and 34 and oriented along the X3 direction by the first guide portion 31 of fiducial structure 3.

Moreover, referring to FIG. 5D, concrete may be poured into the formwork (not shown) provided on both sides of the steel meshes 360 for constructing the shear wall 36. According to the above procedures described, the shear wall 36 is positioned by the fiducial structures 3 and 34 and oriented along the Y3 direction by the second guide portion 32 of fiducial structure 3.

As shown in FIG. 5D, the shear wall 35 and shear wall 36 are interconnected through fiducial structure 3 and extend along the X3 and Y3 directions, respectively, resulting from the guides provided by the first guide portion 31 and the second guide portion 32 of fiducial structure 3. In some embodiments of the present disclosure, the extension direction of shear wall 35 (i.e., the X3 direction) and the extension direction of shear wall 36 (i.e., the Y3 direction) are approximately perpendicular to each other.

Figure 5E:
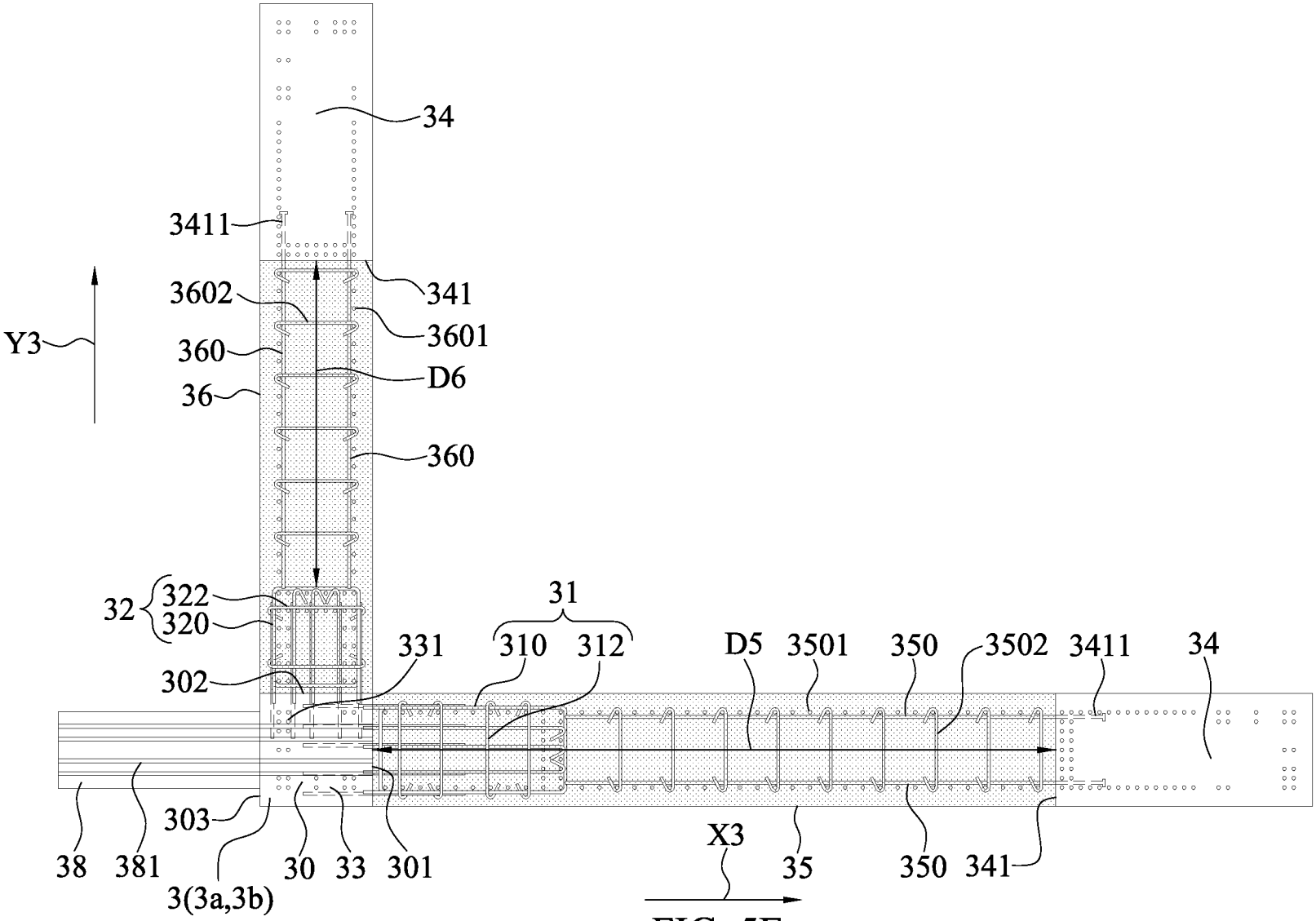
FIG. 5E is a fifth schematic view showing the third embodiment of the present disclosure.

FIG. 5E is a fifth schematic view showing the third embodiment of the present disclosure. As shown in FIG. 5E, a precast beam 38 extends outward from a side 303 of the fiducial structure 3. The transverse reinforcement bars 381 of the precast beam 38 connect to the steel bars on an upper surface 33 of the fiducial structure 3. Since the middle portion 30 of the fiducial structure 3 may be prefabricated, the positions of the steel bars 331 on the upper surface 33 of the fiducial structure 3 can be precisely pre-determined at specific locations, taking into account the positions of the transverse reinforcement bars 381 of the precast beam 38 in advance. Accordingly, when the precast beam 38 is connected to the steel bars provided on top of the fiducial structure 3, the portions of the transverse reinforcement bars 381 of the precast beam 38, that are on or above the upper surface 33 of the fiducial structure 3, will not interfere with the steel bars 331 on the upper surface 33 of the fiducial structure 3.

Figure 6A:
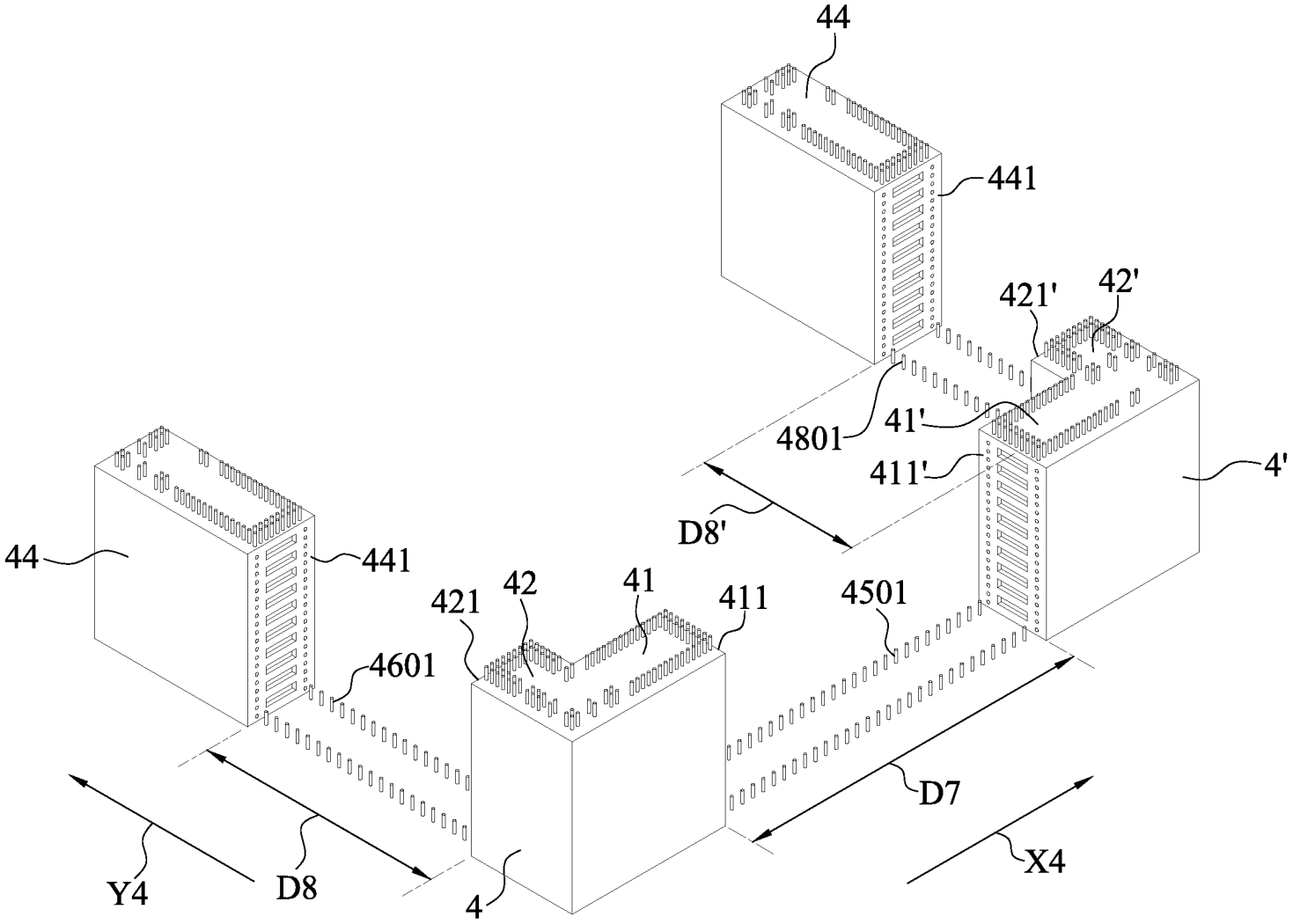
FIG. 6A is a first schematic view showing a fourth embodiment of the present disclosure.

FIG. 6A is a first schematic view showing a construction method in accordance with a fourth embodiment of the present disclosure. As shown in FIG. 6A, precast fiducial structures 4, 4', and 44 are provided on a construction site. In some embodiments of the present disclosure, the fiducial structure 4 or 4' is identical or similar to fiducial structure 1. In some embodiments of the present disclosure, the fiducial structure 44 is identical or similar to fiducial structure 14 in the first embodiment.

The fiducial structure 4 is disposed at the intersection where two shear walls are intended to be constructed. Similarly, the fiducial structure 4' is disposed at the intersection where two shear walls are intended to be constructed. The fiducial structure 4' is positioned in the X4 direction, and the first guide portion 41 of the fiducial structure 4 extends along the X4 direction. The fiducial structure 4' is positioned so that its first guide portion 41' extends in the X4 direction and is substantially aligned with the first guide portion 41 of the fiducial structure 4. The free end 411' of the first guide portion 41' of fiducial structure 4 is approximately located at a distance D7 from the free end 411 of the first guide portion 41 of the fiducial structure 4. In addition, multiple vertical steel bars 4501 are installed on the construction site between fiducial structures 4 and 4'. These steel bars 4501 are substantially arranged along the X4 direction and are intended to be connected with the steel bars at the bottom of the shear wall to be installed later.

The fiducial structure 44 may be positioned at the Y4 direction and substantially aligned with the second guide portion 42 of fiducial structure 4. The fiducial structure 44 is located at a distance of D8 from the free end 421 of the second guide portion 42 of the fiducial structure 4, and the side 441 of the fiducial structure 44 substantially faces toward the second guide portion 42 of the fiducial structure 4. In addition, multiple vertical steel bars 4601 are installed on the construction site between fiducial structures 4 and 44. These steel bars 4601 are substantially arranged along the Y4 direction and are intended to be connected with the steel bars ate the bottom of the shear wall to be installed later.

Moreover, the other fiducial structure 44 is positioned along the extension of the second guide portion 42' of the fiducial structure 4' and is substantially aligned with the second guide portion 42' of the fiducial structure 4'. The side 441 of said the other fiducial structure 44 faces towards the second guide portion 42' of the fiducial structure 4'. In some embodiments of the present disclosure, the second guide portion 42' of the fiducial structure 4' substantially extends along the Y4 direction. Said the other fiducial structure 44 is approximately spaced a distance D8' from the free end 421' of the second guide portion 42' of the fiducial structure 4'. In some embodiments of the present disclosure, the distance is approximately equal to the distance D8. In addition, multiple vertical steel bars 4801 are installed on the construction site between fiducial structures 4' and 44. These steel bars 4801 are substantially arranged along the Y4 direction and are intended to be connected with the steel bars at the bottom of the shear wall to be installed later.

Figure 6B:
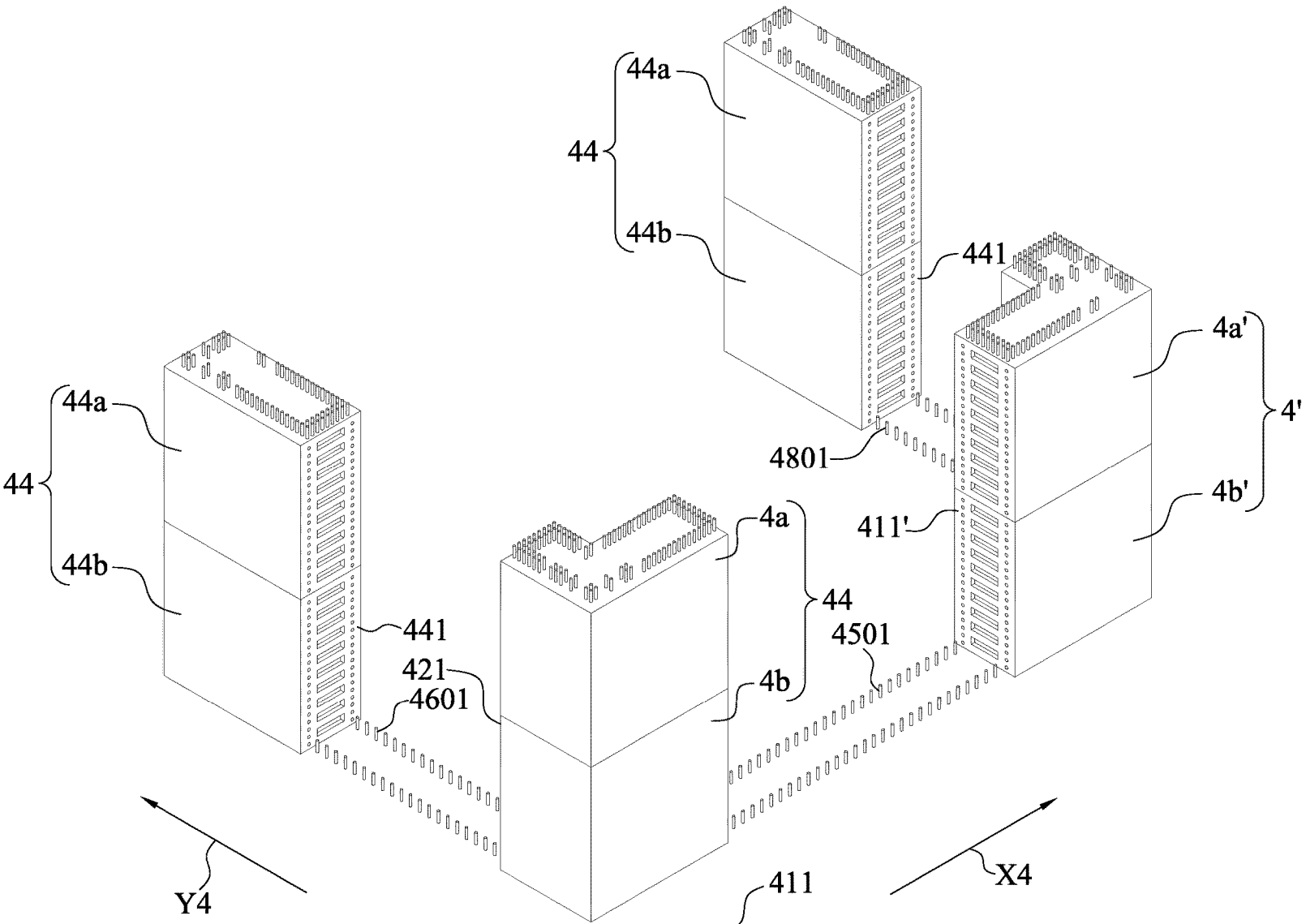
FIG. 6B is a second schematic view showing the fourth embodiment of the present disclosure.

FIG. 6B is a second schematic view showing the fourth embodiment of the present disclosure. As shown in FIG. 6B, another fiducial structure 4*a* is stacked on the top of the original fiducial structure 4*b* that was previously disposed on the construction site. When two identical or similar fiducial structures 4*a*, 4*b* are stacked, the steel bars on the upper surface of the lower fiducial structure 4*b* are aligned and interlocked with the rebar couplers embedded at the bottom of the upper fiducial structure 4. Further, another fiducial structure 4*a'* is stacked on the top of the original fiducial structure 4*b'* that was previously disposed on the construction site. When two identical or similar fiducial structures 4*a'*, 4*b'* are stacked, the steel bars on the upper surface of the lower fiducial structure 4*b'* are aligned and interlocked with the rebar couplers embedded at the bottom of the upper fiducial structure 4*a'*. In addition, another fiducial structure 44*a* is stacked on the top of the original fiducial structure 44*b* that was previously disposed on the construction site. When two identical or similar fiducial structures 44*a*, 44*b* are stacked on each other, the steel bars on the upper surface of the lower fiducial structure 44*b* are aligned and interlocked with the rebar couplers embedded at the bottom of the upper fiducial structure 44*a*.

Figure 6C:
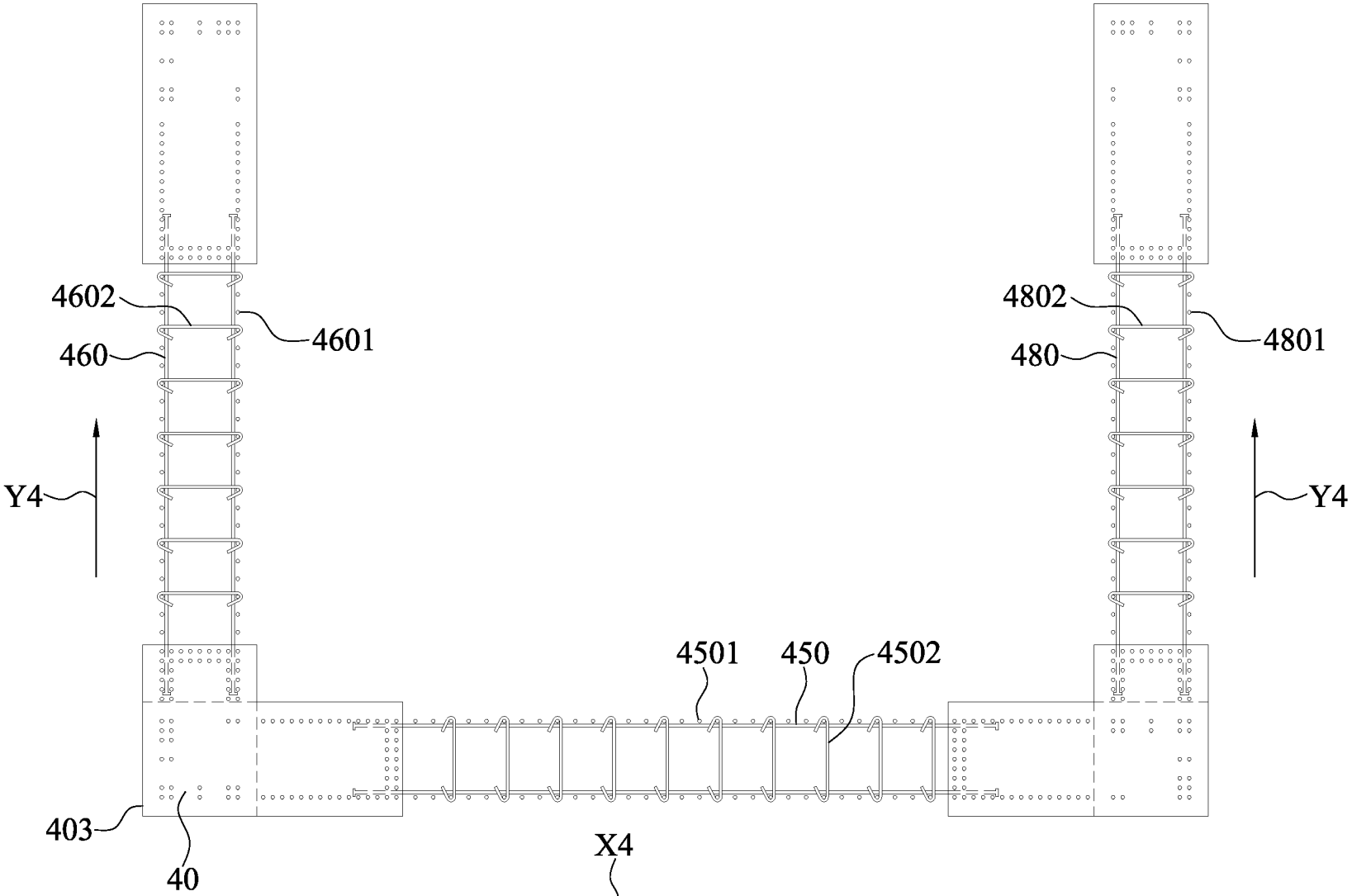
FIG. 6C is a third schematic view showing the fourth embodiment of the present disclosure.

FIG. 6C is a third schematic view showing the fourth embodiment of the present disclosure. On the construction site, two steel meshes 450 may be provided. The steel meshes 450 are placed between the first guide portion 41 of the fiducial structure 4 and the first guide portion 41' of the fiducial structure 4'. The steel meshes 450 extend approximately in the X4 direction and are substantially parallel to each other. The bottom sides of the two steel meshes 450 are connected to the steel bars 4501 fixed to the ground (as shown in FIG. 6A and FIG. 6B). One side of the steel mesh 450 may be connected to the rebar couplers of the first guide portion 41 of fiducial structure 4. In some embodiments of the present disclosure, the outer threaded end of the transverse reinforcement in steel mesh 450 is connected to the inner threaded end of the end portion of the rebar coupler. Further, the opposing ends of the transverse steel bars of reinforcement mesh 450, also have external threads to connect with the internal threads of the end portions of the rebar couplers in the first guide portion 41'. In addition, a multiple of tie bars 4502 are provided between the two steel meshes 450 and the tie bars 4502 are configured to connect and fix the two steel meshes 450 together.

Further, referring to FIG. 6C, on the construction site, two steel meshes 460 may be provided. The steel meshes 460 are placed between the second guide portion 42 of the fiducial structure 4 and fiducial structure 44. They may extend approximately in the Y4 direction and are substantially parallel to each other. The bottom sides of the two steel meshes 460 are connected to the steel bars 4601 fixed to the ground (as shown in FIG. 6A and FIG. 6B). One side of the steel mesh 460 are connected to the rebar couplers of the second guide portion 42 of fiducial structure 4. In some embodiments of the present disclosure, the outer threaded end of the transverse reinforcement in steel mesh 460 is connected to the inner threaded end of the end portion of the rebar coupler. Further, the opposing ends of the transverse steel bars of reinforcement mesh 460, also have external threads to be connected with the internal threads of the end portions of the rebar couplers in the fiducial structure 44. In addition, a multiple of tie bars 4602 may be provided between the two steel meshes 460 and the tie bars 4602 are configured to connect and fix the two steel meshes 460 together.

Moreover, on the construction site, two steel meshes 480 may be provided. The steel meshes 480 are placed between the second guide portion 42' of the fiducial structure 4' and fiducial structure 44. They may extend approximately in the Y4 direction and are substantially parallel to each other. The bottom sides of the two steel meshes 480 are connected to the steel bars 4801 fixed to the ground (as shown in FIG. 6A and FIG. 6B). One side of the steel mesh 480 is connected to the rebar couplers of the second guide portion 42' of fiducial structure 4'. In some embodiments of the present disclosure, the outer threaded end of the transverse reinforcement in steel mesh 480 is connected to the inner threaded end of the end portion of the rebar coupler. Further, the ends of the transverse steel bars of reinforcement mesh 480, at the side opposite to the second guide portion 42', also have external threads to connect with the internal threads of the end portions of the rebar couplers in the fiducial structure 44. In addition, a multiple of tie bars 4802 are provided between the two steel meshes 480 and the tie bars 4802 are configured to connect and fix the two steel meshes 480 together.

Figure 6D:
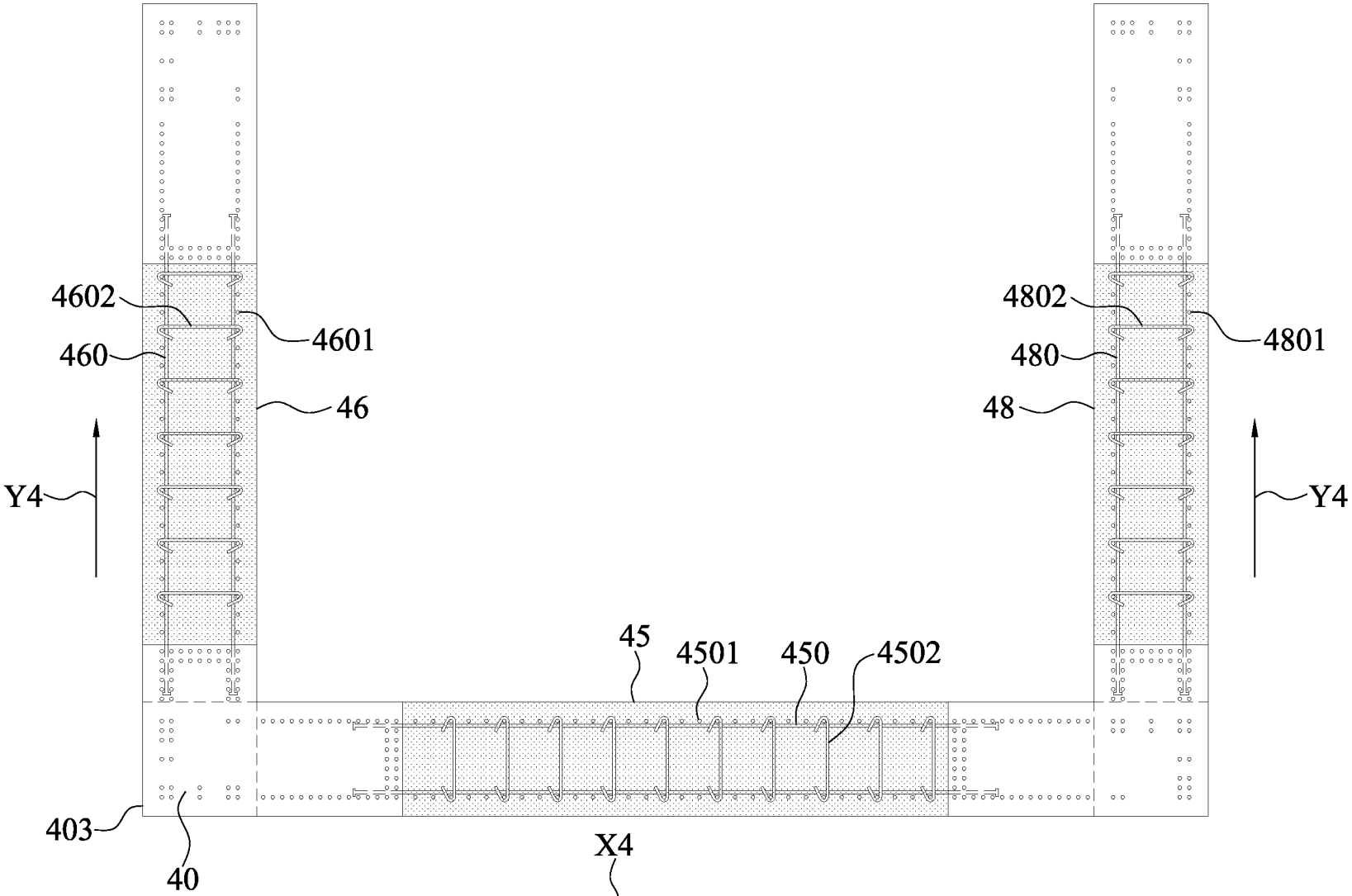
FIG. 6D is a fourth schematic view showing the fourth embodiment of the present disclosure.

FIG. 6D is a fourth schematic view showing the fourth embodiment of the present disclosure. As shown in FIG. 6D, concrete is poured into the formwork (not shown) provided on both sides of the steel meshes 450 for constructing the shear wall 45. According to the above procedures described, the shear wall 45 is positioned by the fiducial structures 4 and 4' and oriented along the X4 direction by the first guide portion 41 of the fiducial structure 4 and/or the first guide portion 41' of the fiducial structure 4'.

Referring to FIG. 6D again, concrete is poured into the formwork (not shown) provided on both sides of the steel meshes 460 for constructing the shear wall 46. According to the above procedures described, the shear wall 46 is positioned by the fiducial structures 4 and 44 and oriented along the Y4 direction by the second guide portion 42 of fiducial structure 4.

Moreover, concrete may be poured into the formwork (not shown) provided on both sides of the steel meshes 480 to construct the shear wall 48. According to the above procedures described, the shear wall 48 is positioned by the fiducial structures 4' and 44 and oriented along the Y4 direction by the second guide portion 42' of fiducial structure 4'.

As shown in FIG. 6D, the shear wall 45 and shear wall 46 are interconnected through the fiducial structure 4 and extend along the X4 and Y4 directions, respectively, resulting from the guides provided by the first guide portion 41 and the second guide portion 42 of fiducial structure 4. Further, the shear wall 45 and shear wall 48 are interconnected through fiducial structure 4' and extend along the X4 and Y4 directions, respectively resulting from the guides provided by the first guide portion 41' and the second guide portion 42' of fiducial structure 4'. In some embodiments of the present disclosure, the extension direction (i.e., direction X4) of shear wall 45 and the extension direction (i.e., direction Y4) of shear wall 46 are approximately perpendicular to each other and the extension direction of shear wall 45 (i.e., direction X4) and the extension direction (i.e., direction Y4) of shear wall 48 are approximately perpendicular to each other.

Figure 6E:
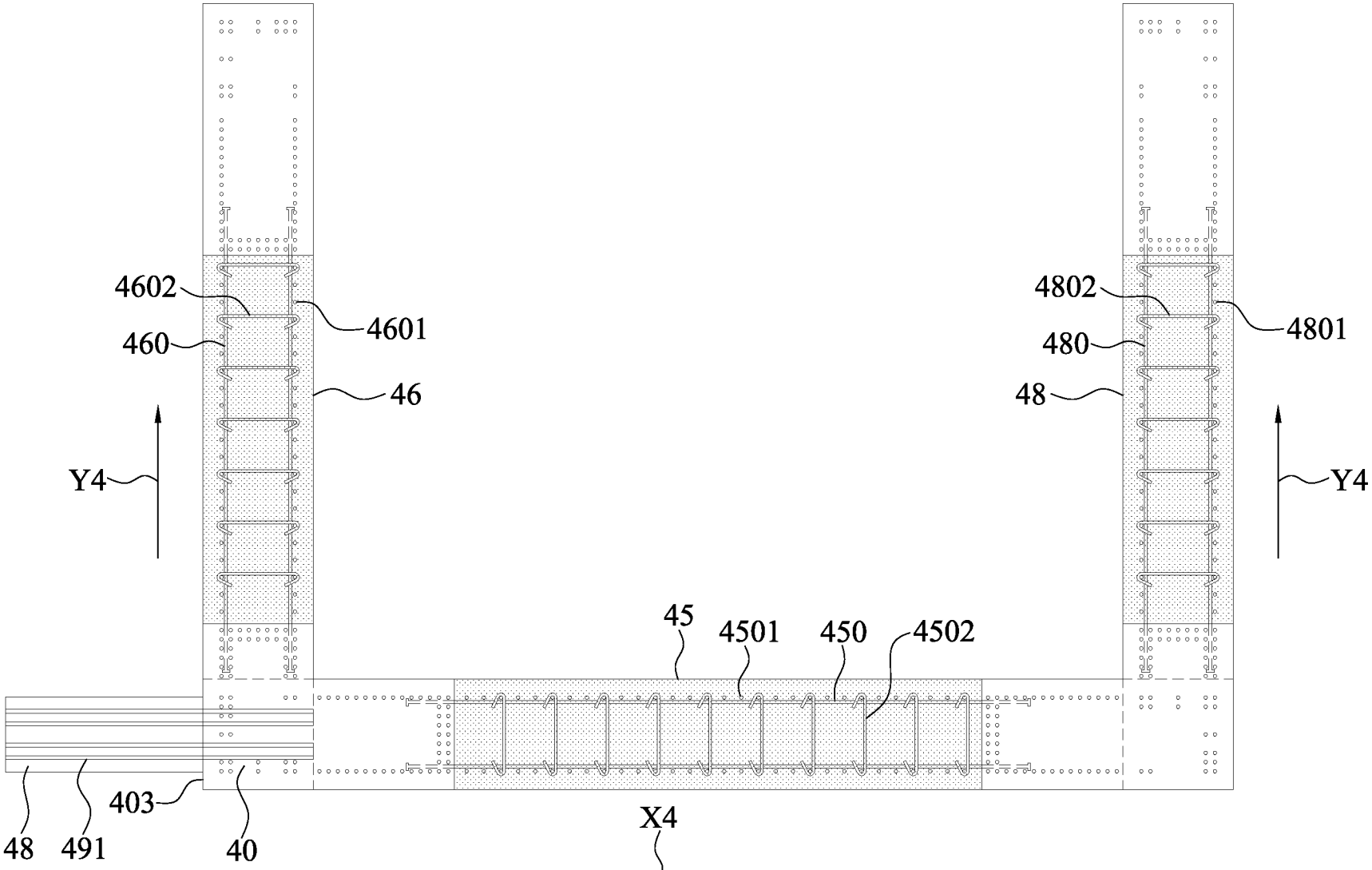
FIG. 6E is a fifth schematic view showing the fourth embodiment of the present disclosure.

FIG. 6E is a fifth schematic view showing the fourth embodiment of the present disclosure. As shown in FIG. 6E, a precast beam 49 extends outward from a side 403 of the fiducial structure 4. The transverse reinforcement bars 491 of the precast beam 49 are connected to the steel bars on an upper surface of the fiducial structure 4. Since the middle portion 40 of the fiducial structure 4 is prefabricated, the positions of the steel bars on the upper surface of the fiducial structure 4 can be precisely pre-determined at specific locations, taking into account the positions of the transverse reinforcement bars 491 of the precast beam 49 in advance. Accordingly, when the precast beam 49 is connected to the steel bars provided on or above the top of the fiducial structure 4, the portions of the transverse reinforcement bars 491 of the precast beam 49, that extend along the upper surface of the fiducial structure 4, will not be interfered with the steel bars on the upper surface of the fiducial structure 4.

The above embodiments merely describe the principle and effects of the present disclosure, instead of being used to limit the present disclosure. Therefore, persons skilled in the art can make modifications to and variations of the above embodiments without departing from the spirit of the present disclosure. The scope of the present disclosure should be defined by the appended claims.

What is claimed is:

1. A construction method, comprising:

providing a first fiducial structure, wherein the first fiducial structure has a precast column structure, a first portion extending along a first direction from the precast column structure, a second portion extending along a second direction from the precast column structure, wherein the first direction and the second direction are angled relative to each other; wherein the step of providing the first fiducial structure comprising:

providing a first sub-fiducial structure, wherein the first sub-fiducial structure has a plurality of steel bars protruded from its top;

providing a second sub-fiducial structure, wherein the second sub-fiducial structure has a plurality of couplers embedded in its bottom and wherein the couplers of the second sub-fiducial structure are arranged to correspond to the steel bars of the first sub-fiducial structure; and engaging the couplers of the second sub-fiducial structure with the steel bars of the first sub-fiducial structure so that the first and second sub-fiducial structures are joined together; and providing a first shear wall extending along the first direction;

connecting a first end of the first shear wall to the first portion of the first fiducial structure;

providing a second shear wall extending along the second direction; and connecting a first end of the second shear wall to the second portion of the first fiducial structure.

2. The method of claim 1, further comprising:

providing a second fiducial structure at the first direction or the second direction and spaced apart from the first fiducial structure by at a predetermined distance; and connecting the second fiducial structure to a second end of the first shear wall, which is opposite to the first end of the first shear wall, or to a second end of the second shear wall, which is opposite to the second end of the second shear wall.

3. The method of claim 2, wherein the step of providing the first fiducial structure comprises: precasting the precast column structure, the first portion and the second portion of the first fiducial structure together.

4. The method of claim 3, wherein the step of providing the first fiducial structure comprises along a height of the first fiducial structure, pre-embedding a plurality of couplers in a free end of the first portion and a free end of the second portion, wherein an end of each of the couplers that is exposed on the free end of the first portion or the second portion, has internal threads, and wherein an opposing end of each of the coupler has an T-shaped structure.

5. The method of claim 3, wherein the step of providing the first fiducial structure comprises along a height of the first fiducial structure, pre-embedding a plurality of first couplers in a free end of the first portion and a free end of the second portion wherein the step of providing the second fiducial structure comprises along a height of the second fiducial structure, pre-embedding a plurality of second couplers in an end of the second fiducial structure that faces the first fiducial structure.

6. The method of claim 5, further comprising:

connecting steel bars of the first shear wall to the first couplers in the first fiducial structure, and connecting steel bars of the second shear wall to the second couplers in the second fiducial structure;

wherein the step of connecting a first end of the first shear wall to the first portion of the first fiducial structure comprises: connecting the steel bars extending from the first end of the first shear wall, to the first couplers in the first portion of the first fiducial structure, and the step of connecting a first end of the second shear wall to the second portion of the first fiducial structure comprises: connecting the steel bars extending from the first end of the second shear wall, to the first couplers in the second portion of the first fiducial structure;

wherein the step of connecting the second fiducial structure to a second end of the first shear wall or to a second end of the second shear wall comprises: connecting the steel bars extending from the second end of the first shear wall or the steel bars extending from the second end of the second shear wall, to the second couplers in the second fiducial structure.

7. The method of claim 2, wherein the step of the providing the second fiducial structure comprising:

providing a third sub-fiducial structure, wherein the third sub-fiducial structure has a plurality of steel bars protruded from its top;

providing a fourth sub-fiducial structure, wherein the fourth sub-fiducial structure has a plurality of couplers embedded in its bottom and wherein the couplers are arranged to correspond to the steel bars; and engaging the couplers of the fourth sub-fiducial structure with the steel bars of the third sub-fiducial structure so that the third and fourth sub-fiducial structures are joined together.

8. The method of claim 1, wherein the step of providing the first fiducial structure comprises: constructing the first portion of the first fiducial structure and the second portion of the first fiducial structure on-site.

9. The method of claim 8, further comprising:

providing and tying a plurality of first tie bars to steel bars extending from the precast column structure and extending along the first direction on-site so as to form the steel bars for the first portion; and providing and tying a plurality of second tie bars to steel bars extending from the precast column structure and extending along the second direction on-site so as to form the steel bars for the second portion.

10. The method of claim 1, wherein the step of providing the first fiducial structure comprises: precasting the precast column structure of the first fiducial structure and the first portion of the first fiducial together and constructing the second portion of the first fiducial structure on-site.

11. The method of claim 10, further comprising:

providing and tying a plurality of third tie bars to steel bars extending from the precast column structure and along the second direction on-site so as to form the steel bars for the second portion.

12. The method of claim 1, wherein the step of the providing the first and second shear walls is after the step of the providing the first fiducial structure, and wherein the first shear wall and the second shear wall are constructed along the first direction and the second direction respectively.

13. A fiducial structure used for connecting two shear walls extending in two different directions, comprising:

a precast column structure;

a first portion connected to a first side of the precast column; and a second portion connected to a second side of the precast column, wherein the second side is adjacent to the first side;

wherein the first portion is configured to connect one of the two shear walls, and the second portion is configured to connect the other one of the two shear walls;

wherein the precast column structure and the first portion of the fiducial structure are precast together, and wherein a free end of the first portion is pre-embedded with a plurality of couplers along a height of the fiducial structure, and one end of each of the couplers, that is exposed on the free end of the first portion, has inner threads and the opposing end of each of the couplers has a T-shaped structure.

14. The fiducial structure of claim 13, wherein the precast column structure and the first and second portions of the fiducial structure are precast together, and wherein a free end of the second portion are pre-embedded with a plurality of couplers along a height of the fiducial structure, and one end of each of the couplers that is exposed on the free end of the second portion, has inner threads and the opposing end of each of the couplers has a T-shaped structure.

15. The fiducial structure of claim 13, a length of the first portion is different from a length of the second portion so that the fiducial structure is L-shaped.

16. The fiducial structure of claim 13, wherein the first portion has a first end surface configured to connect one of the two shear walls, and the first end surface of the first portion has a plurality of recesses, and wherein the second portion has a second end surface configured to connect the other of the two shear walls, and the second end surface of the second portion has a plurality of recesses.

17. The fiducial structure of claim 13, wherein the first direction and the second direction form an angle of approximately 90 degrees.

* * * * *